US012778299B2

(12) United States Patent
Masunaga

(10) Patent No.: US 12,778,299 B2
(45) Date of Patent: Nov. 3, 2026

(54) CHAIR

(71) Applicant: OKAMURA CORPORATION, Yokohama (JP)

(72) Inventor: Hiroshi Masunaga, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 106 days.

(21) Appl. No.: 18/844,830

(22) PCT Filed: Mar. 10, 2023

(86) PCT No.: PCT/JP2023/009297
§ 371 (c)(1),
(2) Date: Sep. 6, 2024

(87) PCT Pub. No.: WO2023/171795
PCT Pub. Date: Sep. 14, 2023

(65) Prior Publication Data

US 2025/0228367 A1 Jul. 17, 2025

(30) Foreign Application Priority Data

Mar. 11, 2022 (JP) ..... 2022-038444

(51) Int. Cl.
*A47C 1/032* (2006.01)
*A47C 3/026* (2006.01)
*A47C 7/44* (2006.01)

(52) U.S. Cl.
CPC ..... *A47C 1/03255* (2013.01); *A47C 3/026* (2013.01); *A47C 7/443* (2013.01)

(58) Field of Classification Search
CPC ..... A47C 1/03255; A47C 3/026; A47C 7/443; A47C 1/03272; A47C 1/03294; A47C 1/03266
See application file for complete search history.

(56) References Cited

U.S. PATENT DOCUMENTS 4,479,679 A * 10/1984 Fries ..... A47C 1/03255 297/321
5,328,237 A * 7/1994 Yamaguchi ..... A47C 7/443 297/303.4

(Continued)

FOREIGN PATENT DOCUMENTS

CN 117999017 A * 5/2024 ..... A47C 1/03272
EP 2578113 A1 * 4/2013 ..... A47C 1/03272

(Continued)

OTHER PUBLICATIONS 5 page PDF of English translation of the written opinion mailed May 16, 2023 for PCT/JP0203/009297 (Year: 2023).*

(Continued)

*Primary Examiner* — Robert Canfield
(74) *Attorney, Agent, or Firm* — NIXON PEABODY LLP; Jeffrey L. Costellia

(57) ABSTRACT

A spring member is disposed so that a biasing direction is in a forward/rearward direction, and includes a front side engagement portion disposed on a front portion of the spring and a rear side engagement portion disposed on a rear portion of the spring, a seat includes a front side spring receiving portion engaged with a front side engagement portion, a backrest or a support structure includes a rear side spring receiving portion engaged with the rear side engagement portion and an adjustment portion configured to adjust a position of the rear side engagement portion in the upward/downward direction together with the rear side spring receiving portion, and an upper limit position of the rear side engagement portion of the spring member adjusted by the adjustment portion is located above an pivot axis at which the backrest is rotatably supported by the support structure.

14 Claims, 17 Drawing Sheets

(56) References Cited

U.S. PATENT DOCUMENTS

| | | | | |
|---|---|---|---|---|
| 2005/0156453 | A1* | 7/2005 | Lin | A47C 7/443 297/300.5 |
| 2021/0368982 | A1* | 12/2021 | Slongo | A47C 1/03255 |
| 2024/0389755 | A1* | 11/2024 | Masunaga | A47C 7/40 |
| 2025/0000259 | A1* | 1/2025 | Masunaga | A47C 1/024 |
| 2025/0176720 | A1* | 6/2025 | Masunaga | A47C 1/03255 |

FOREIGN PATENT DOCUMENTS

| | | | | |
|---|---|---|---|---|
| JP | 06-261818 | A | 9/1994 | |
| JP | 11-253264 | A | 9/1999 | |
| JP | 2000-139605 | A | 5/2000 | |
| JP | 2000-184927 | A | 7/2000 | |
| JP | 2003-009999 | A | 1/2003 | |
| JP | 2003-310378 | A | 11/2003 | |
| JP | 4848099 | B2 | 12/2011 | |
| JP | 2023046970 | A * | 4/2023 | A47C 1/03272 |
| WO | 2010-056838 | A1 | 5/2010 | |
| WO | WO-2023047633 | A1 * | 3/2023 | A47C 1/03272 |

OTHER PUBLICATIONS

International Search Report for Application No. PCT/JP2023/009297, mailed May 16, 2023, (6 pages).

* cited by examiner

CHAIR

TECHNICAL FIELD

The present invention relates to a chair.

Priority is claimed on Japanese Patent Application No. 2022-038444, filed Mar. 11, 2022, the content of which is incorporated herein by reference.

BACKGROUND ART

In the related art, as a backrest of a chair used for office work or the like, there is known a configuration including a backrest supported by a support structure to be rotatable around an axis extending in a widthwise direction of the support structure, and a biasing means configured to bias the backrest in a direction of returning to an initial state.

In a chair disclosed in Patent Document 1, a backrest is tiltably supported by a support structure, and a spring member is disposed behind a backrest area with respect to the support structure of the backrest. In the configuration disclosed in Patent Document 1, a spring member pivots around an engaging portion with a seat as a fulcrum, a vertical position of the spring member in the engaging area with the backrest is adjusted, and thus, a distance between two compression points can be changed, i.e., an accumulated biasing force can be changed.

CITATION LIST

Patent Document

Patent Document 1: Japanese Patent No. 4848099

SUMMARY OF INVENTION

Technical Problem to be solved by Invention

However, in the chair disclosed in Patent Document 1, since an adjustment range of the vertical position of the spring member in the engaging area with the backrest is limited to an area below a rotation axis (pivot axis) of the support structure and the backrest, an adjustment width may be narrowed. For this reason, while the adjustment width can be largely secured by extending the position of the lower end portion of the backrest downward, since the backrest is too large, there are problems with design and there is room for improvement in that regard.

Here, in consideration of the above-mentioned circumstances, the present invention is directed to providing a chair capable of enlarging an adjustment region of a biasing force of a spring member by enlarging an adjustment range of a position in an upward/downward direction of a contact area between the spring member and a backrest.

Solution to Problem

In order to achieve the aforementioned objects, the present invention employs the following means.

That is, a chair according to a first aspect of the present invention includes a support structure; a backrest that is rotatably supported by the support structure around an pivot axis in a chair widthwise direction and that is displaceable in a forward/rearward direction between a standing state and an inclined state; a seat that has a front side supported part movably supported in the forward/rearward direction relative to a front portion of the support structure and a rear side supported part supported at a position above the pivot axis, and that is displaceable in the forward/rearward direction depending on displacement of the backrest with respect to the support structure; and a spring member that is provided in a state compressed between the seat and the backrest or between the seat and the support structure and that is configured to bias the backrest in a direction of returning to the standing state, the spring member being disposed so that a biasing direction is in the forward/rearward direction, and including a front side engagement portion disposed on a front portion of the spring and a rear side engagement portion disposed on a rear portion of the spring, the seat including a front side spring receiving portion engaged with the front side engagement portion, the backrest or the support structure including a rear side spring receiving portion configured to engage with the rear side engagement portion and an adjustment portion configured to adjust a position of the rear side engagement portion in an upward/downward direction together with the rear side spring receiving portion, and an upper limit position of the rear side engagement portion of the spring member adjusted by the adjustment portion being located above the pivot axis.

In the chair configured in this way, since the position of the rear side engagement portion of the spring member is located above the pivot axis, the rear side engagement portion of the spring member is displaced rearward without being displaced forward when the backrest is tilted from the standing state to the inclined state. That is, when the backrest is tilted, the spring member is not compressed by the rear side engagement portion, but only compressed by the front side engagement portion of the spring member which is attached to the seat, which is displaced rearward as the backrest tilts. Then, the biasing force in this case is smaller than that in the case in which the spring is compressed by both the backrest and the seat. Accordingly, in the present invention, it is possible to secure a large adjustment region in the upward/downward direction of the rear side engagement portion (rear side spring receiving portion) of the spring member by using the adjustment portion in the region above the pivot axis. That is, the adjustment portion allows the adjustment width of the spring reaction force to be increased without requiring a large adjustment region below the pivot axis of the backrest.

A chair according to a second aspect of the present invention includes a support structure; a backrest that is rotatably supported by the support structure around an pivot axis in a chair widthwise direction and that is displaceable in a forward/rearward direction between a standing state and an inclined state; a seat that has a front side supported part movably supported in the forward/rearward direction relative to a front portion of the support structure and a rear side supported part supported at a position above the pivot axis, and that is displaceable in the forward/rearward direction depending on displacement of the backrest with respect to the support structure; and a spring member that is provided in a state compressed between the support structure and the backrest and that is configured to bias the backrest in a direction of returning to the standing state, the spring member being disposed so that a biasing direction is in the forward/rearward direction, and includes a front side engagement portion disposed on a front portion of the spring and a rear side engagement portion disposed on a rear portion of the spring, the support structure including a front side spring receiving portion configured to engage with the front side engagement portion, the backrest including a rear side spring receiving portion configured to engage with the rear side engagement portion and an adjustment portion configured to adjust a position of the rear side engagement portion in the upward/downward direction together with the rear side spring receiving portion, and an upper limit position of the rear side engagement portion of the spring member adjusted by the adjustment portion being located above the pivot axis.

In addition, in the chair according to the above-mentioned first and second aspects of the present invention, the upper limit position of the rear side engagement portion may be disposed in front of and below the rear side supported part, and a distance between the pivot axis and the rear side engagement portion at the upper limit position may be smaller than a distance between the pivot axis and the rear side supported part.

In the chair configured in this way, the rear side engagement portion of the spring member, which is located above the pivot axis, does not move forward toward which the spring member is compressed when the backrest tilts. Specifically, while the spring member moves rearward to extend, since the biasing force from the spring member attempting to return to its natural length state is applied to the rear side supported part located on the rear portion of the seat and the distance between the pivot axis and the upper limit position of the rear side engagement portion of the spring member is smaller than the distance between the pivot axis and the rear side supported part, a pressing force from above is constantly applied to the rear side engagement portion of the spring member via the backrest. This pressing force acts as a biasing force of the spring member to resist the rearward movement of the rear side engagement portion, preventing the spring member from extending in a way that would cause the rear side engagement portion to move rearward, thereby biasing the backrest in a direction in which it would pivot rearward.

In addition, in the chair according to the first and second aspects of the present invention, the front side engagement portion may be engaged with the seat in a state in which upward displacement is restricted.

In the chair configured in this way, since the spring member does not extend upward, rearward displacement of the seat can be reliably converted into a force of pressing the front side engagement portion of the spring member from the front to the rear.

In addition, in the chair according to the first and second aspects of the present invention, the front side supported part may move rearward and downward when the backrest is displaced from the standing state to the inclined state.

In the chair configured in this way, since the spring member does not extend upward during the process of displacing the seat, the rearward displacement of the seat can be reliably converted into a force of pressing the front side engagement portion of the spring member from the front to the rear.

In addition, in the chair according to the first and second aspects of the present invention, the front side supported part may extend rearward and downward.

In addition, in the chair according to the first and second aspects of the present invention, a lower limit position of the rear side engagement portion of the spring member adjusted by the adjustment portion may be located below the pivot axis.

In addition, in the chair according to the first and second aspects of the present invention, the rear side supported part of the seat may be rotatably connected to the backrest.

Advantageous Effects of Invention

According to the chair according to the present invention, it is possible to enlarge the adjustment region of the biasing force of the spring member by enlarging the adjustment range of the position in the upward/downward direction of the contact area between the spring member and the backrest.

DESCRIPTION OF EMBODIMENTS

Figure 1:
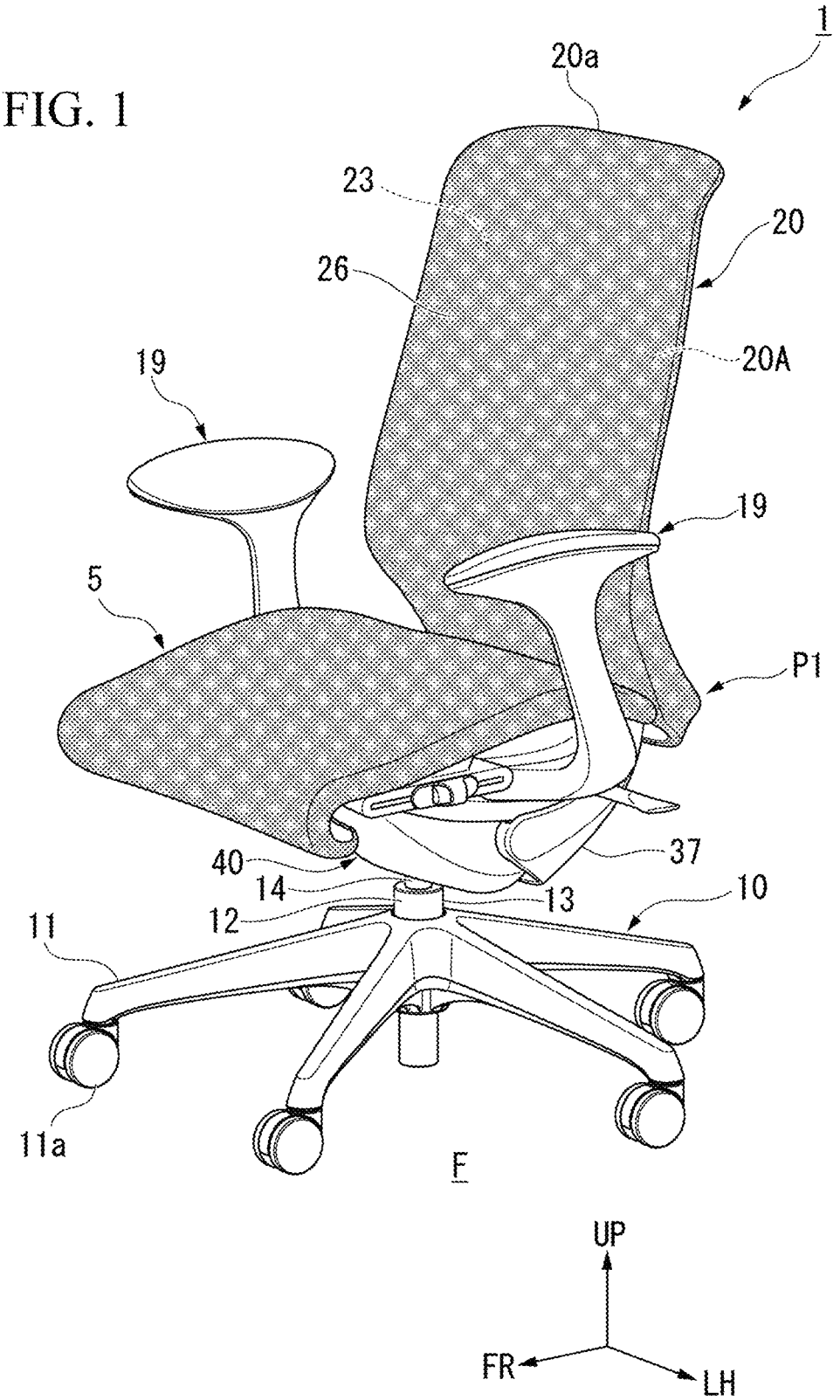
FIG. 1 is a perspective view showing a chair according to an embodiment of the present invention from obliquely above.

Hereinafter, a chair according to an embodiment of the present invention will be described with reference to the accompanying drawings.

In the following description, for convenience of explanation, a direction in which a seated person sitting in a regular posture on a seat 5 (described below) faces forward is referred to as "forward" and the opposite direction is referred to as "rearward." In addition, directions of upward, downward, leftward and rightward in the following description mean directions that coincide with directions of the seated person when the seated person sits on the seat 5 in a regular posture. A side where leg parts 10 (described below) are located is referred to as a lower side of the chair, a side where a backrest 20 (described below) is located is referred to as an upper side of the chair, a right side of the seated person sitting on the seat 5 in a regular posture is referred to as a right side of the chair, and a left side of the seated person is referred to as a left side of the chair. In the following description, a leftward/rightward direction at this time is also referred to as a widthwise direction (chair widthwise direction). Further, in appropriate places in the drawings, an arrow FR indicates the forward direction, an arrow UP indicates the upward direction, and an arrow LH indicates the leftward direction.

As shown in FIG. 1, a chair 1 according to the embodiment includes the leg parts 10 installed on a floor surface F, a box-shaped support base 40 installed on upper portions of the leg parts 10, the seat 5 attached to an upper portion of the support base 40, the backrest 20 attached to a rear portion of the support base 40 to support the back of the seated person, and armrests 19 extending from both side portions of a lower side of the seat 5 toward above the seat 5 and on which elbows or arms of the seated person are placed.

The leg parts 10 have multi-pronged legs 11 equipped with casters 11*a*, and a leg pillar 12 in which a gas spring (not shown) that is a lifting mechanism standing up from a central portion of the multi-pronged legs 11 is installed. The leg pillar 12 has an outer tube 13 and an inner tube 14. The outer tube 13 is fitted to and supported by the multi-pronged legs 11 in a non-rotatable manner. A lower portion of the inner tube 14 is rotatably supported in the outer tube 13 in a horizontal direction (rotatable around a shaft that extends vertically). An upper portion of the inner tube 14 is fixed to the support base 40. A height adjustment mechanism of the leg pillar 12 and a tilting mechanism of the backrest 20 are installed in the support base 40.

Figure 2:
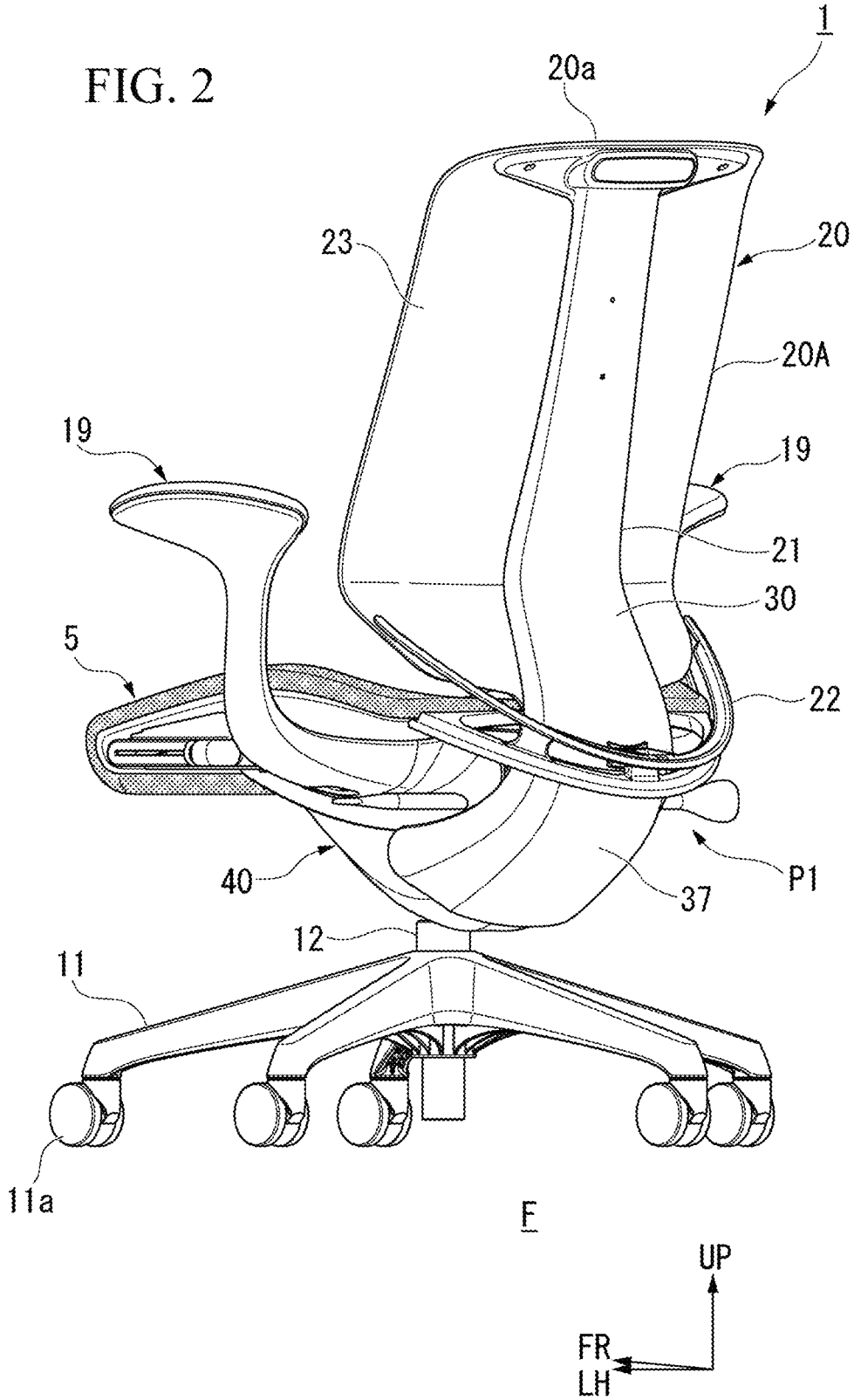
FIG. 2 is a perspective view showing a state in which a covering material is removed from the chair according to the embodiment of the present invention when seen from obliquely behind.

The backrest 20 has a backrest structure 20A (see FIG. 2), and a covering material 26 configured to cover the backrest structure 20A. The backrest structure 20A receives the back of the seated person. As shown in FIG. 2, the backrest structure 20A has a backrest support body 21, and a backrest main body 23 supported by the backrest support body 21.

The backrest support body 21 supports the back of the seated person. The backrest support body 21 has a backrest support member 30, and a rear extension member 22.

Figure 3:
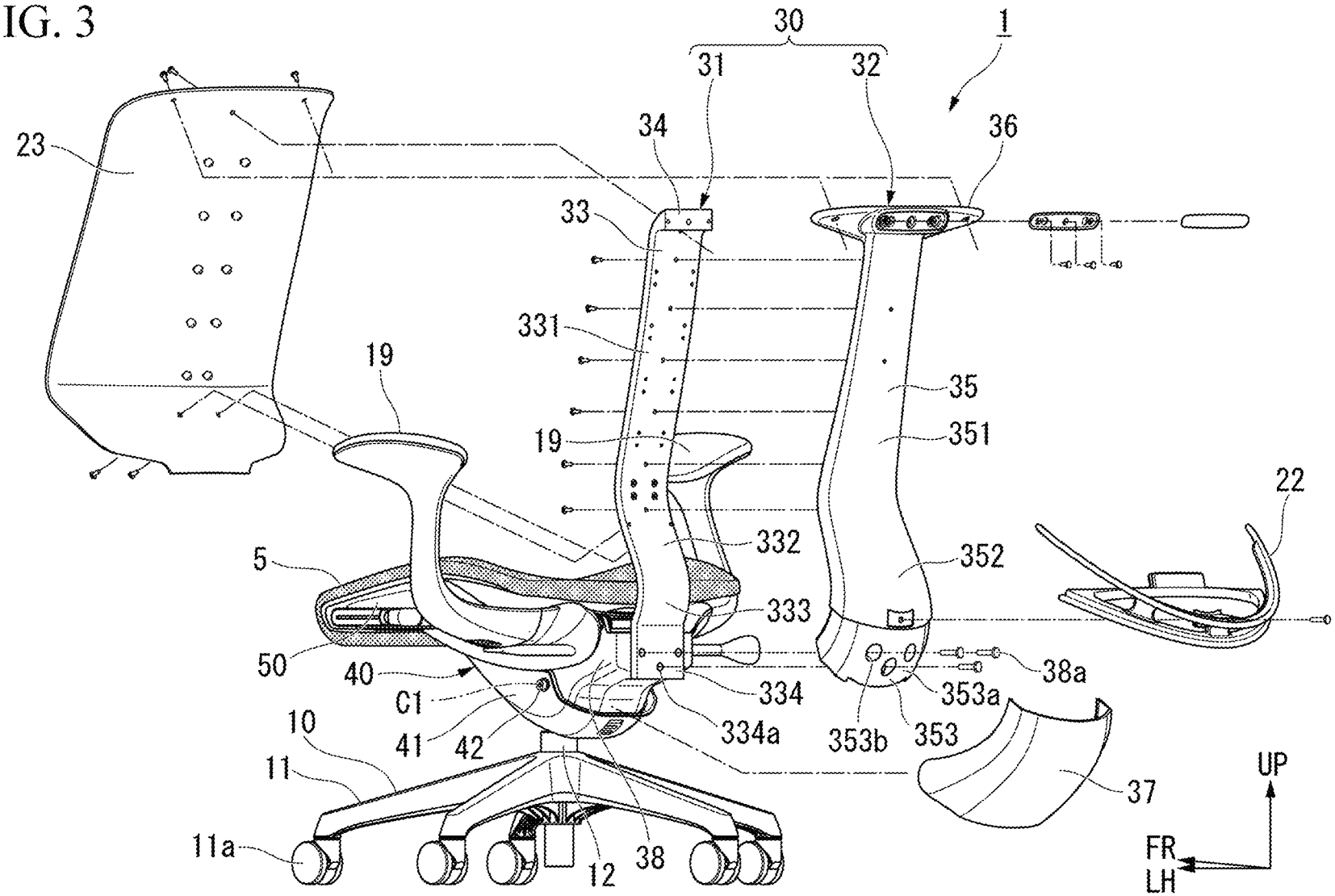
FIG. 3 is an exploded perspective view of the chair according to the embodiment of the present invention.

As shown in FIG. 3, the backrest support member 30 has an inner member 31, and an outer member 32. The inner member 31 is elongated in the upward/downward direction. The inner member 31 is formed in a flat plate shape.

A plate surface of the inner member 31 is oriented substantially in the forward/rearward direction. The inner member 31 has an inner upward/downward extension part 33, and an inner upper portion overhanging part 34. The inner upward/downward extension part 33 has an inner curved upper portion 331, an inner curved lower portion 332, an inner lower portion 333, and an inner lower fixing part 334.

The outer member 32 has an outer upward/downward extension part 35, and an outer upward extension part 36. The outer upward/downward extension part 35 has an outer curved upper portion 351, an outer curved lower portion 352, and an outer lower portion 353. The inner member 31 and the outer member 32 are connected by a screw.

Figure 4:
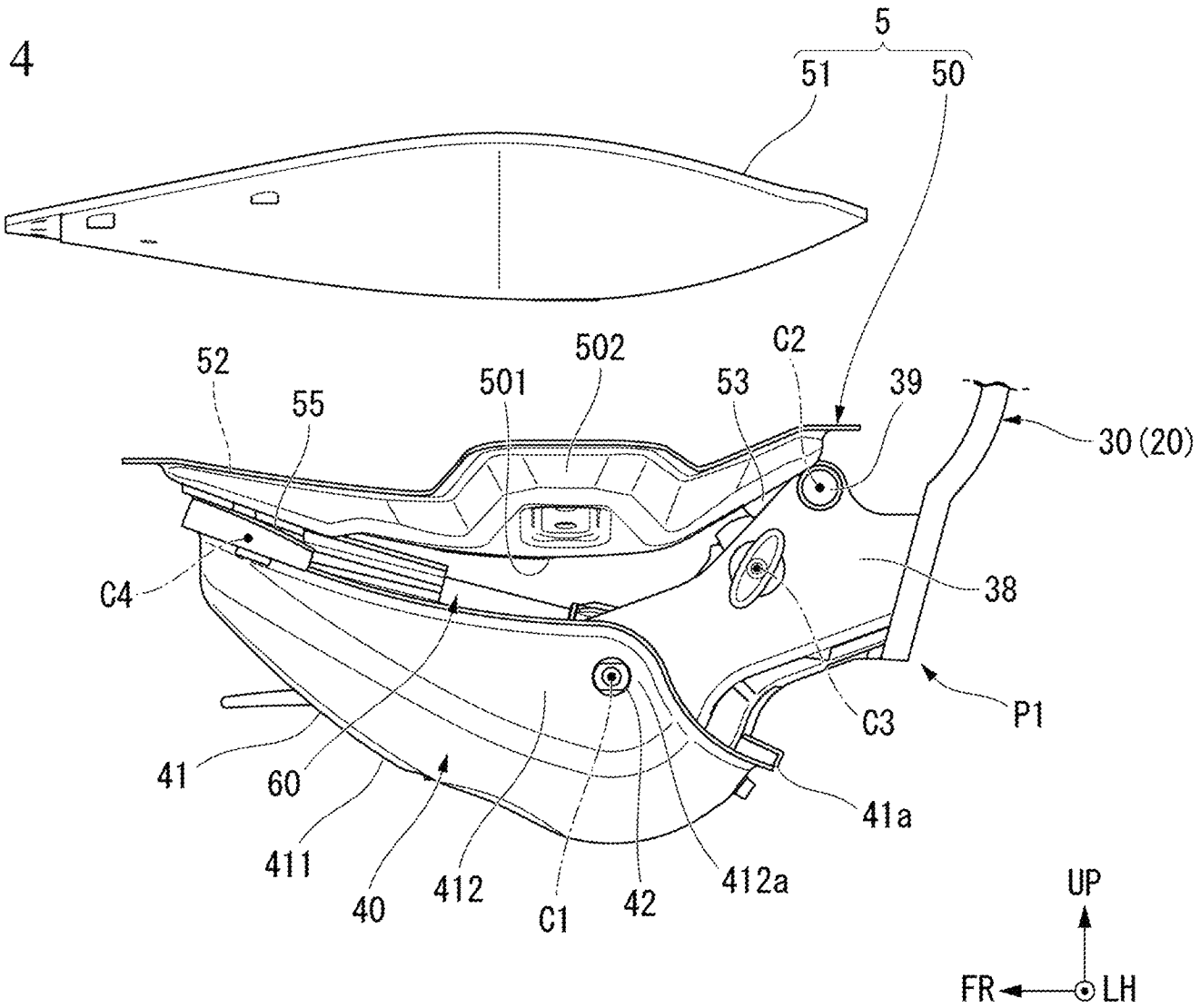
FIG. 4 is a partially exploded side view showing a configuration of a seat, a backrest and a support base of the chair according to the embodiment of the present invention.
Figure 5:
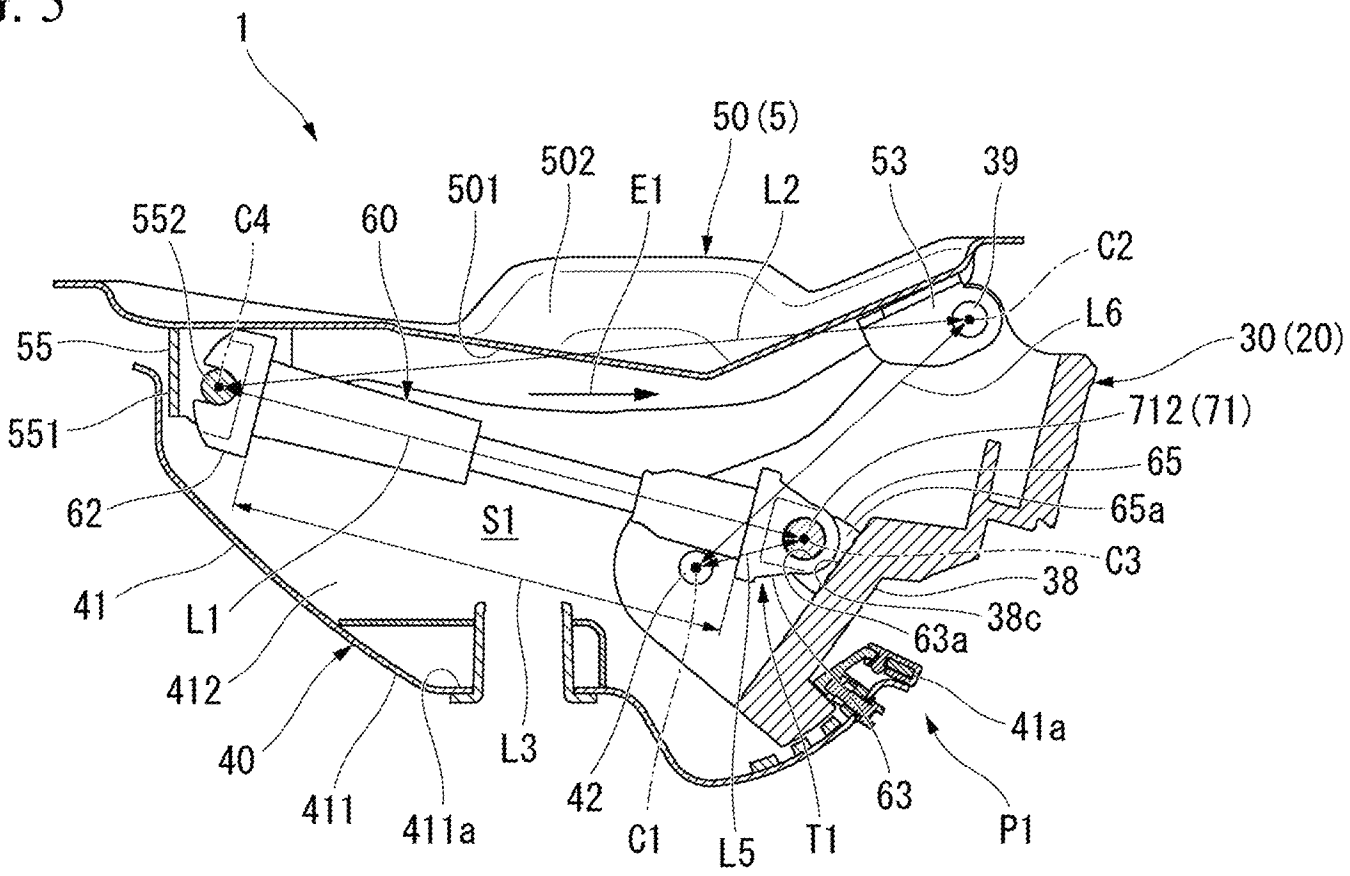
FIG. 5 is a cross-sectional view along line V-V shown in FIG. 10, showing a longitudinal cross section of the configuration of FIG. 4.

A pivoting member 38 fixed to the inner member 31 and the outer member 32 and pivotable via a pivoting shaft 42 around a first pivot axis C1 (pivot axis) in the widthwise direction (leftward/rightward direction) at a rear portion of the support base 40 is provided on the backrest support member 30 of the backrest 20 (see FIG. 4 and FIG. 5).

The inner member 31 and the outer member 32 are integrated by inserting a bolt 38*a* through an attachment hole 353*b* provided in an attachment concave portion 353*a* of the outer lower portion 353 of the outer member 32, an attachment hole 334*a* of the inner lower fixing part 334 of the inner member 31 and an attachment hole (not shown) formed in the pivoting member 38 and fastening a nut (not shown) to the bolt 38*a*, and fixed to the pivoting member 38.

As shown in FIG. 3, the pivoting member 38 and the outer lower portion 353 of the outer member 32 are covered with a rear cover 37 from behind.

Figure 14:
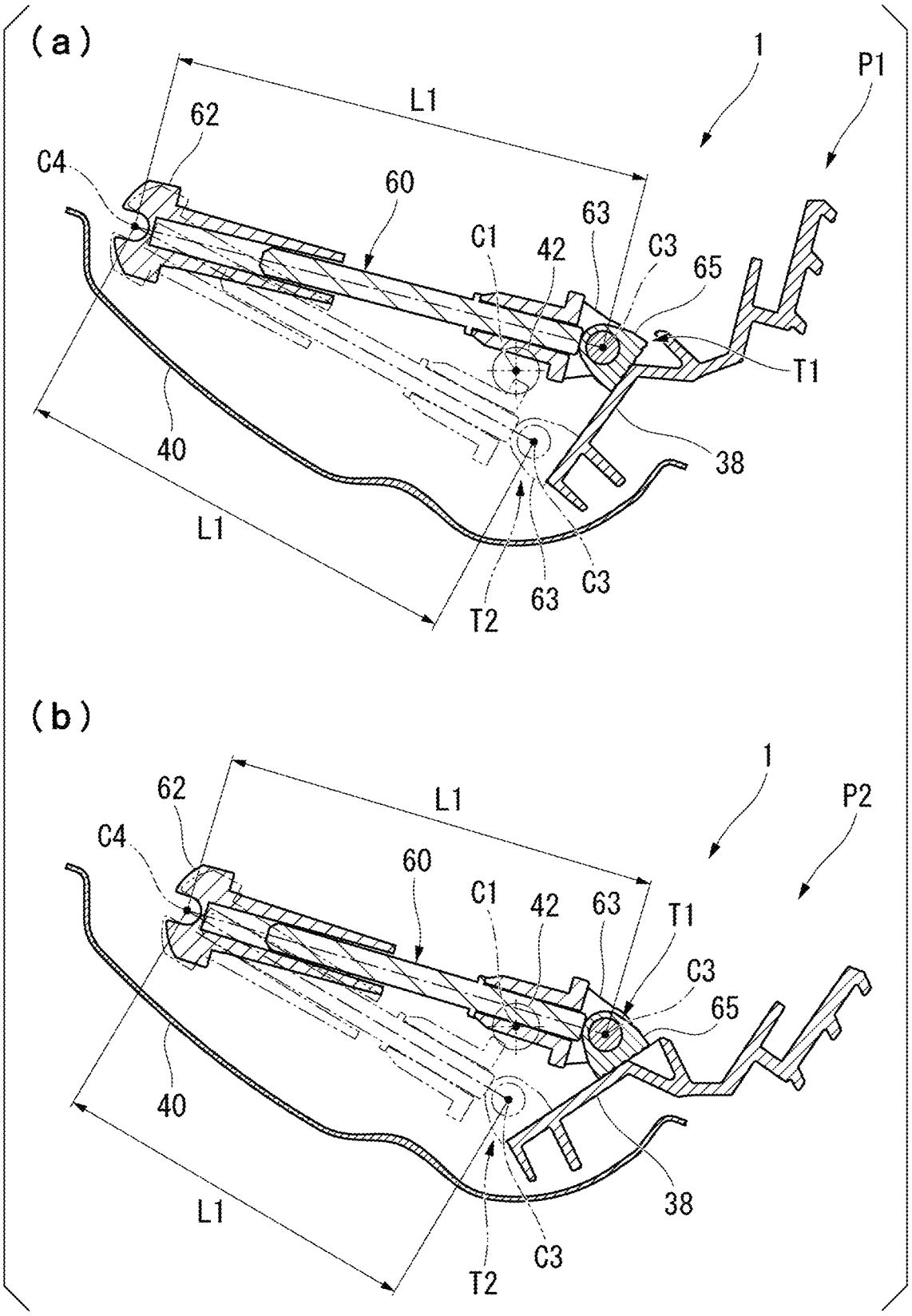
FIG. 14 is a view schematically showing a pivoted state of the backrest, part (a) is a view of an standing state, and part (b) is a view of an inclined state.

As shown in FIG. 1 and FIG. 2, the backrest 20 configured in this way is supported to be rotatable around the first pivot axis C1 (the pivoting shaft 42) relative to the support base 40, and provided to be displaceable in the forward/rearward direction from an standing state P1 (see part (a) of FIG. 14) that is an standing state in which an upper end portion 20*a* is located relatively forward to an inclined state P2 (see part (b) of FIG. 14) in which the upper end portion 20*a* is located relatively rearward.

As shown in FIG. 4 and FIG. 5, the seat 5 is provided to be displaceable in the forward/rearward direction according to the displacement of the backrest 20 with respect to the support base 40. The seat 5 includes a seat main body 51, and a seat supporting member 50 configured to support the seat main body 51 from below.

The seat supporting member 50 is formed in a rectangular shape in a plan view seen from above such that the seat main body 51 can be attached to an upper edge. The seat supporting member 50 is a strengthening member made of a metal material such as drawn sheet metal, aluminum die-cast, or the like, and has a receiver shape that is open upward in the upward/downward direction.

Figure 6:
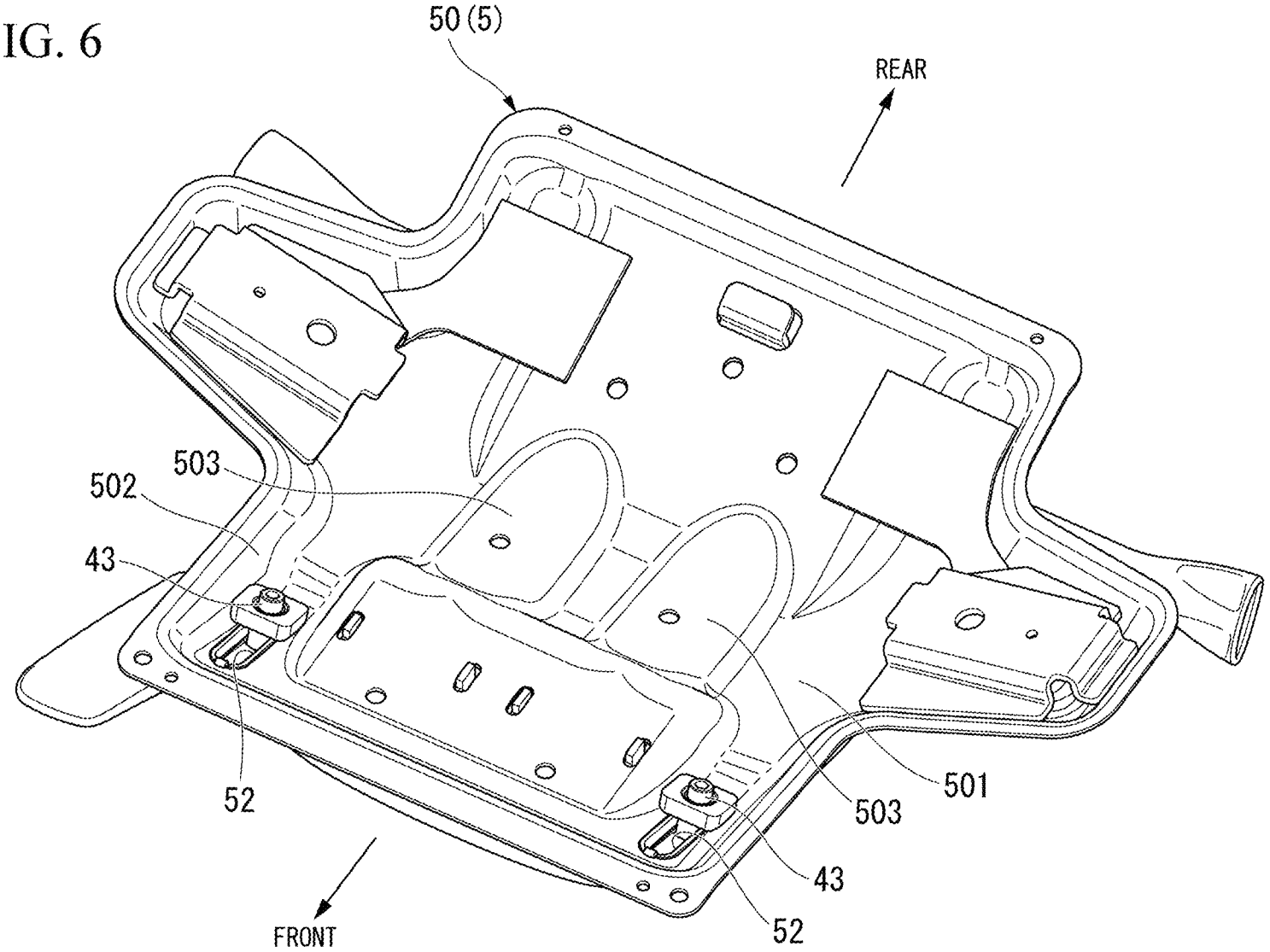
FIG. 6 is a perspective view showing a seat supporting member from obliquely above and ahead.

As shown in FIG. 5 and FIG. 6, the seat supporting member 50 includes a slot 52 (front side supported part) relatively movably supported with respect to a front portion of the support base 40 in the forward/rearward direction, a rear attachment portion 53 (rear side supported part) supported at a position above the first pivot axis C1, and a front side spring receiving portion 55 rotatably engaged with a front portion of a compression coil spring 60, which will be described below.

The seat supporting member 50 is disposed in front of the rear attachment portion 53 and above a third pivot axis C3, which will be described below, and rotatably engaged with the front portion of the compression coil spring 60 around a fourth pivot axis C4, which will be described below.

Figure 7:
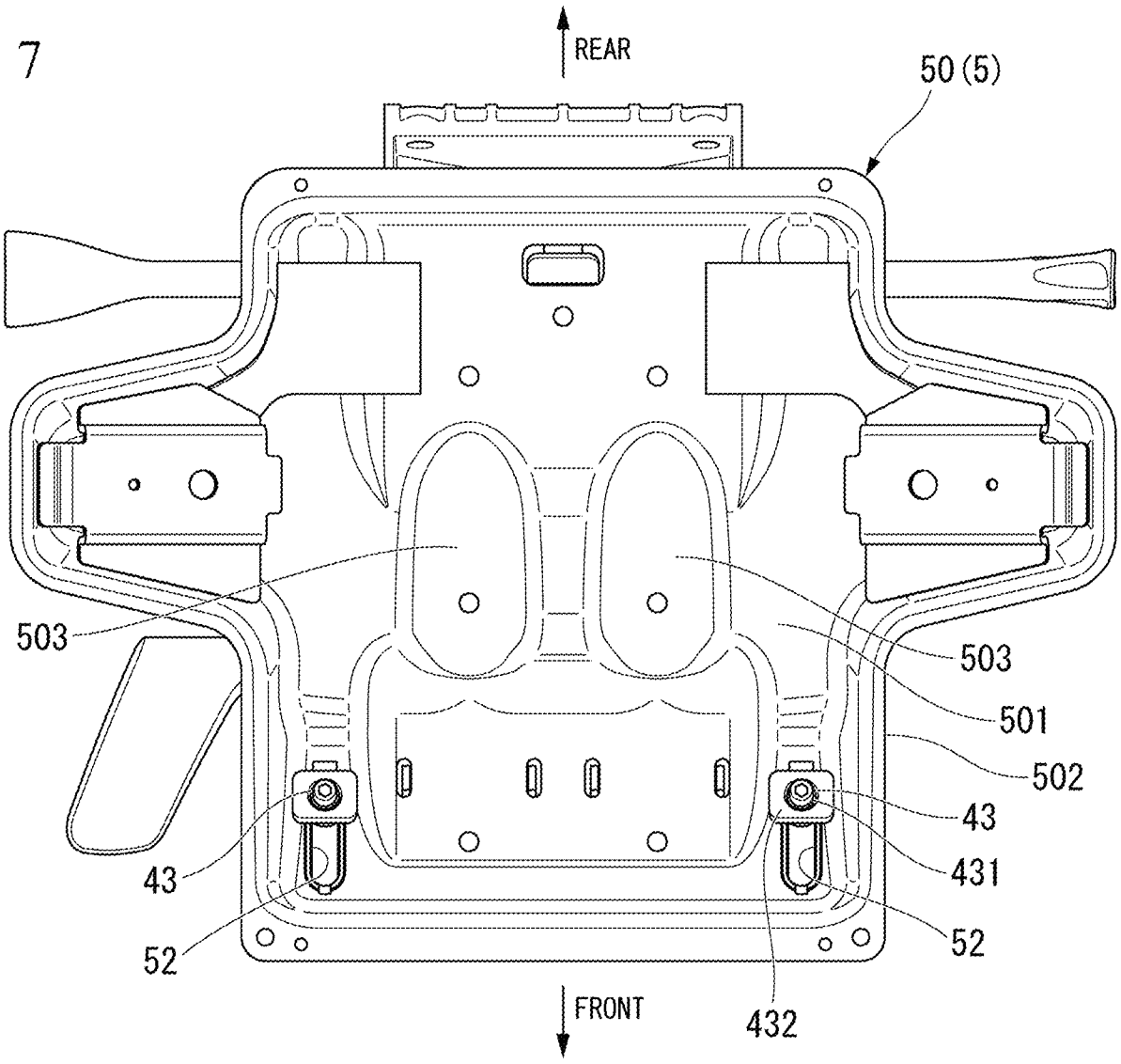
FIG. 7 is a plan view showing the seat supporting member from above.

Specifically, as shown in FIG. 5 to FIG. 7, the seat supporting member 50 has a bottom wall portion 501, and sidewall portions 502 standing up from a circumferential portion of the bottom wall portion 501. The above-mentioned seat main body 51 (see FIG. 4) is attached to upper end portions of the sidewall portions 502. The bottom wall portion 501 has a convex portion 503 extending along an external form of the compression coil spring 60 in the forward/rearward direction and protruding upward so as not to interfere with the compression coil spring 60 disposed therebelow, which will be described below.

Figure 8:
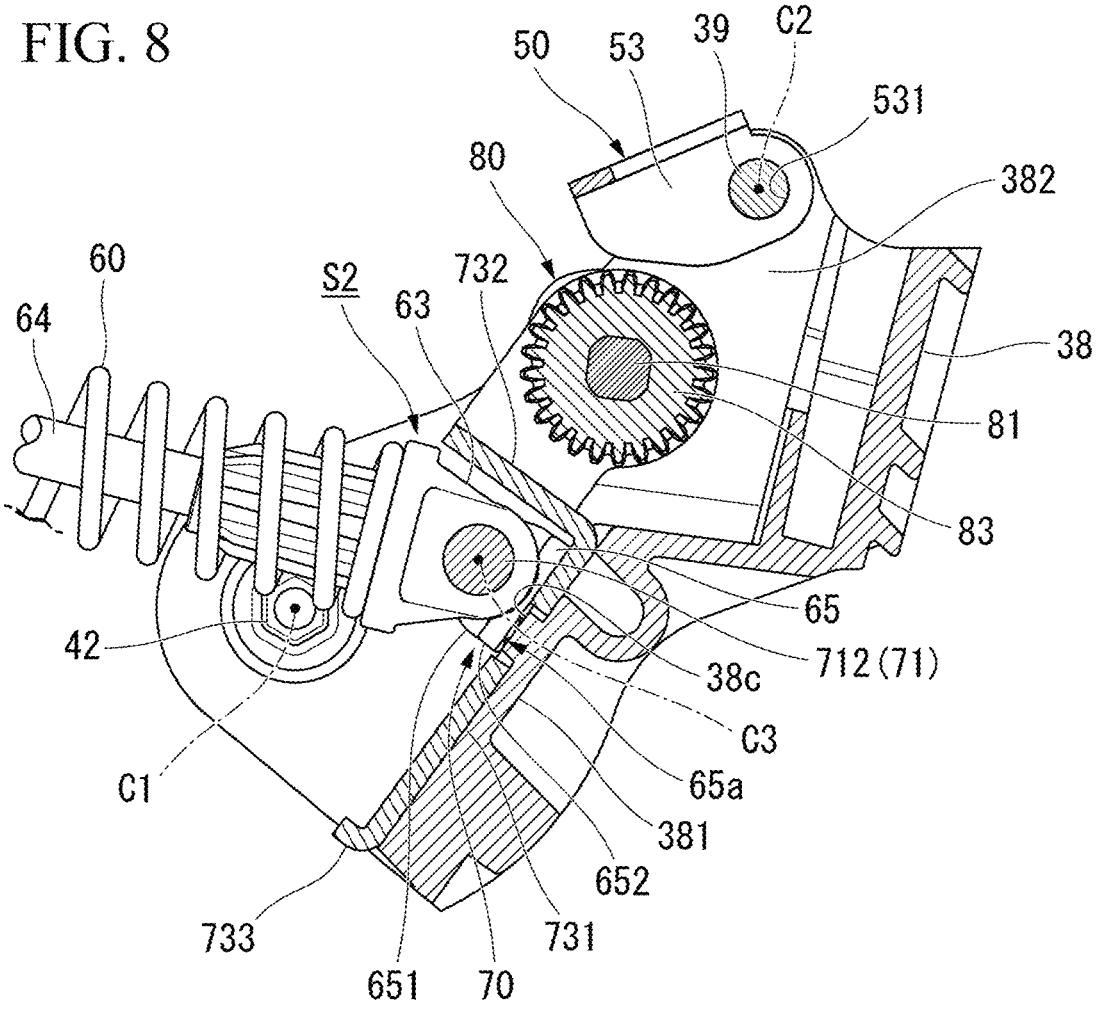
FIG. 8 is an enlarged view of a major part of FIG. 5.

As shown in FIG. 5 and FIG. 8, the rear attachment portion 53 is connected to the pivoting member 38 of the backrest support member 30 to be rotatable around a shaft member 39 extending in the widthwise direction, which will be described below. Here, an pivot axis of the shaft member 39 is referred to as a second pivot axis C2.

As shown in FIG. 8, the rear attachment portion 53 is provided to protrude downward from a rear end lower portion of the seat supporting member 50, and has a rotation shaft hole 531 passing in the widthwise direction. The shaft member 39 is rotatably inserted through the rotation shaft hole 531. The rear attachment portion 53 (i.e., the seat supporting member 50) is rotatable about the shaft member 39 with respect to the pivoting member 38 (see FIG. 5). That is, as shown in FIG. 5, the seat supporting member 50 moves rearward relative to the support base 40 when the backrest 20 moves from the standing state P1 (see part (a) of FIG. 14) to the inclined state P2 (see part (b) of FIG. 14). Here, an arrow E1 shown in FIG. 5 indicates a moving direction of the seat supporting member 50 when it shifts from the standing state P1 to the inclined state P2.

As shown in FIG. 6 and FIG. 7, the two slots 52 are provided in the front portion of the bottom wall portion 501 on both sides in the widthwise direction at an interval. An engaging protrusion 43 (see FIG. 9 and FIG. 10) protruding upward from the front portion of the support base 40 is slidably engaged with each of the two slots 52 in the longitudinal direction (forward/rearward direction) of the slot 52 in a state in which downward movement of the engaging protrusion 43 is restricted such that it is not removed downward from the slot 52. When the backrest 20 is tilted, the slot 52 slides rearward relative to the engaging protrusion 43 provided on the support base 40 and the seat supporting member 50 moves rearward. That is, when the seat supporting member 50 moves rearward, a position of the engaging protrusion 43 with respect to the slot 52 in the forward/rearward direction is a position relatively moved from the rear to the front. In this way, a trajectory of the displacement of the slot 52 when the backrest 20 is tilted is only a component in the forward/rearward direction, and an upward component is not included.

The slot 52 of the embodiment passes through the bottom wall portion 501 in the upward/downward direction, and extends rearward and downward. For example, by forming the slot 52 in a portion of the bottom wall portion 501 that is inclined rearward and downward (in the embodiment, a front portion), the slot 52 can be configured to extend rearward and downward. The engaging protrusion 43 is inserted into the slot 52 so as to be movable in the longitudinal direction while being prevented from slipping out downward by a sliding portion 432 described below. For this reason, when the backrest 20 is displaced from the standing state to the inclined state, the slot 52 of the seat supporting member 50 is moved rearward and downward while being guided by the engaging protrusion 43.

As shown in FIG. 9 to FIG. 12, the front side spring receiving portion 55 has two fixing portions 551 provided on both sides in the widthwise direction and fixed to a lower surface of the bottom wall portion 501 of the seat supporting member 50, and a front side spring reaction force receiving shaft 552 configured to connect the two fixing portions 551 in the widthwise direction and receive a spring reaction force. Here, the pivot axis of the front side spring reaction force receiving shaft 552 is referred to as the fourth pivot axis C4. The front side spring receiving portion 55 is provided between the two slots 52 disposed at an interval in the widthwise direction.

The fixing portions 551 are members formed by bending a plate member into a C shape, and have two reinforcement walls 551A facing each other in the widthwise direction. The reinforcement walls 551A are disposed in a state in which a surface direction is perpendicular to the fourth pivot axis C4 and extends in the upward/downward direction. The front side spring reaction force receiving shaft 552 penetrates each of the two reinforcement walls 551A in the two fixing portions 551. A front portion (a front side engagement portion 62) of the compression coil spring 60, which will be described below, is supported by the front side spring reaction force receiving shaft 552 located between the two reinforcement walls 551A of the fixing portions 551. In this way, in the embodiment, the reinforcement walls 551A are disposed between the slots 52 of the front side spring receiving portion 55.

The front side spring reaction force receiving shaft 552 is a rod member having a circular cross section. The front side spring reaction force receiving shaft 552 is inserted through the plurality of (four) reinforcement walls 551A and fixed to the reinforcement walls 551A so as not to move in the leftward/rightward direction. The front side engagement portion 62 of the compression coil spring 60 that was compressed is supported by the front side spring reaction force receiving shaft 552 of each of the fixing portions 551.

As shown in FIG. 3, the support base 40 includes a support base main body portion 41 (support structure) fixed to an upper portion of the leg pillar 12 (see FIG. 1), the pivoting shaft 42 configured to pivotably support the pivoting member 38 of the backrest support member 30 with respect to the support base main body portion 41 around the first pivot axis C1 in a tilting direction, and the engaging protrusion 43 (see FIG. 9 and FIG. 10) configured slidably support the seat supporting member 50 in the forward/rearward direction.

As shown in FIG. 5, the support base main body portion 41 has a lower wall 411 that constitutes a lower shielding surface 411*a*, and two sidewalls 412 extending upward from both left and right sides of the lower wall 411, and is formed in a bowl shape that opens upward as a whole. In other words, above the lower wall 411 and between the two left and right sidewalls 412 is made as a space (a first internal space S1). The lower shielding surface 411*a* is located below a rear side engagement portion 63.

The two compression coil springs 60 (spring members) are arranged in parallel in the widthwise direction and accommodated in the first internal space S1 (see FIG. 9) above the support base main body portion 41. A rear end portion 41*a* of the support base main body portion 41 overhangs rearward from rear upper portions 412*a* of the sidewalls 412. The support base main body portion 41 has the pivoting shaft 42 provided on the rear upper portion 412*a* of the sidewalls 412 located on both the left and right sides so as to be immovable relative to the rear upper portion 412*a*.

Figure 10:
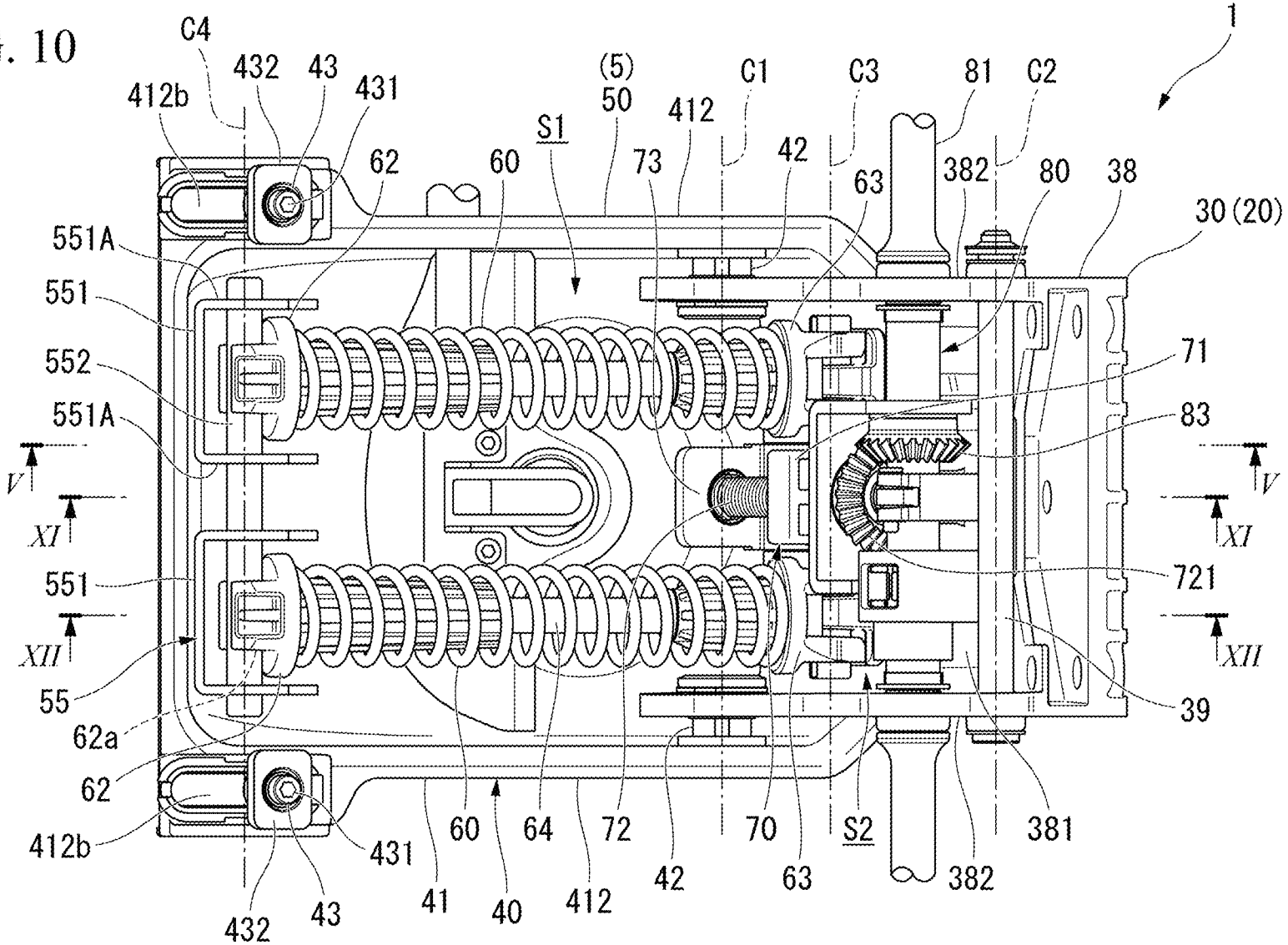
FIG. 10 is a plan view of the configuration shown in FIG. 9 from above.

A front portion of the pivoting member 38 of the backrest support member 30 is pivotably supported by the pivoting shaft 42 at inside the rear portion of the support base main body portion 41. As shown in FIG. 10, the pivoting shafts 42 provided on the sidewalls 412 on both sides in the widthwise direction are coaxially disposed on the first pivot axis C1. Further, the pivoting shaft 42 may be arranged to be non-rotatable relative to the pivoting member 38. In this case, the pivoting shaft 42 is pivotably provided on the sidewalls 412 relative to each other.

Figure 9:
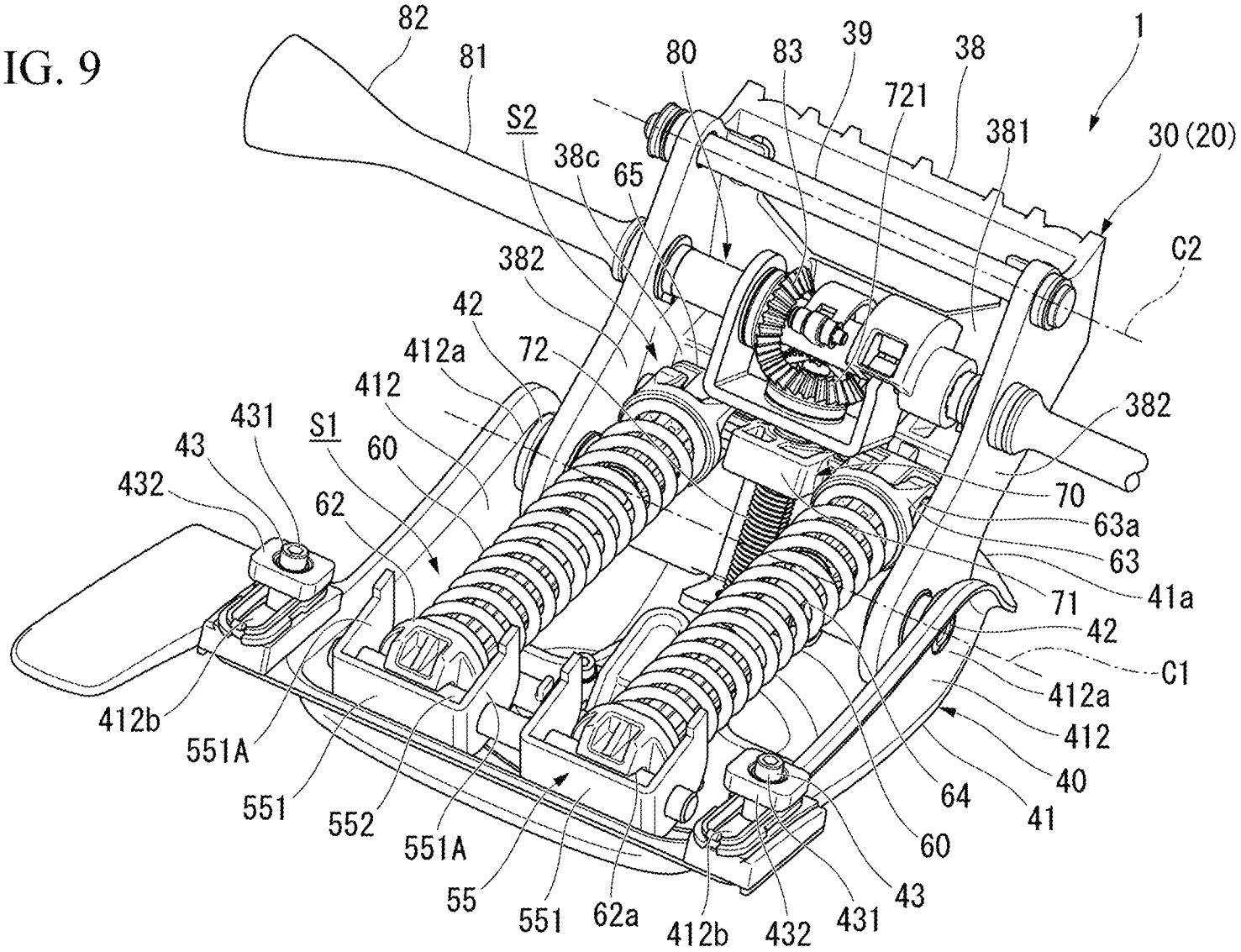
FIG. 9 is a perspective view showing a support base including a compression coil spring and a part of the backrest when seen from front and above obliquely.

As shown in FIG. 9 and FIG. 10, the engaging protrusion 43 is provided to protrude upward from front upper ends 412*b* of the sidewalls 412 on both the left and right sides of the support base main body portion 41. The engaging protrusion 43 has a protrusion 431, and the sliding portion 432 provided on an upper end of the protrusion 431 and formed to have a diameter larger than that of the protrusion. The protrusion 431 is formed to have a circular cross section with a diameter dimension that is approximately the same as the width dimension of the slot 52 of the seat supporting member 50 (see FIG. 6 and FIG. 7). The engaging protrusion 43 has the protrusion 431 inserted through the slot 52, and the sliding portion 432 disposed inside the seat supporting member 50.

Further, a portion of the seat supporting member 50 in which the sliding portion 432 is disposed is an upper surface of the bottom wall portion 501 and disposed between the two sidewall portions 502. A sliding region of the sliding portion 432 in the inner portion of the seat supporting member 50 is a position that avoids the convex portion 503 (see FIG. 5) protruding upward in a shape along the external form of the compression coil spring 60 described above, and is a space in which the sliding portion 432 that is sliding does not interfere with another area. That is, a disposition portion of the slot 52 and a sliding region of the sliding portion 432 are set to both left and right positions that avoid the two compression coil springs 60 when seen in a plan view.

The backrest 20 in the inclined state P2 (see part (b) of FIG. 14), the seat 5 in conjunction with the tilting of the backrest 20 and displaced in a direction shown by an arrow E1, the compression coil spring 60 (spring member) configured to bias in a direction of returning to the standing state P1 (see part (a) of FIG. 14), an adjustment portion 70 configured to adjust a biasing force of the compression coil spring 60, and an operating part 80 connected to the adjustment portion 70 and configured to actuate the adjustment portion 70 are provided in the support base main body portion 41 of the support base 40 and the pivoting member 38.

As shown in FIG. 8 to FIG. 10, the pivoting member 38 has a rear wall 381, and two sidewalls 382 (side pieces) extending from both left and right ends of the rear wall 381 in a perpendicular direction and separated from each other in the widthwise direction. A second internal space S2 is formed between the two sidewalls 382. The adjustment portion 70 and the operating part 80 are accommodated in the second internal space S2 in front of the pivoting member 38. In addition, a rear end portion of the compression coil spring 60 is supported by (accommodated in) the front portion of the second internal space S2.

The two sidewalls 382 of the pivoting member 38 are pivotably supported by the pivoting shaft 42 relative to the rear upper portions 412*a* of the sidewalls 412 of the support base main body portion 41. The adjustment portion 70 and the operating part 80 are disposed in the second internal space S2 located behind the pivoting shaft 42 in the pivoting member 38. The front portion of the pivoting member 38 supports the pivoting shaft 42. In addition, the rear portion of the pivoting member 38 includes the shaft member 39 to which the rear attachment portion 53 of the seat supporting member 50 is attached. Then, the pivoting member 38 supports an operating shaft 81 of the operating part 80 in the intermediate portion between the front portion and the rear portion.

As shown in FIG. 8, the shaft member 39 that constitutes the second pivot axis C2 extends in the widthwise direction. Both sides of the shaft member 39 in the widthwise direction are supported by the sidewalls 382. The rear attachment portion 53 of the seat supporting member 50 is rotatably supported by the shaft member 39. That is, the rear portion of the seat supporting member 50 is rotatably supported relative to the pivoting member 38.

As shown in FIG. 5 and FIG. 9 to FIG. 12, the compression coil spring 60 is arranged with its biasing direction facing the forward/rearward direction. The compression coil spring 60 is provided while being compressed between the backrest 20 and the seat 5 (the seat supporting member 50), and biased in a direction of returning the backrest 20 and the seat 5 to the standing state P1 by being deformed according to displacement of the seat supporting member 50 in the forward/rearward direction. That is, the compression coil spring 60 is configured to provide a returning force for returning the backrest 20 tilted by a load input to the backrest main body 23 from the front (a load input by the seated person with the back leaning against the backrest main body 23) and the seat 5 to an original position (the standing state P1 shown in FIG. 8 or part (a) of FIG. 14) using the biasing force. The compression coil spring 60 has the front side engagement portion 62 provided on one end portion (front portion) of the compression coil spring 60, and the rear side engagement portion 63 provided on the other end portion (rear portion).

Further, the portion of the backrest 20 that supports the load of the seated person from the front (in the embodiment, the backrest main body 23) is located above the first pivot axis C1.

As the compression coil spring 60 is compressed in the forward/rearward direction, the front side engagement portion 62 is displaced rearward, and the rear side engagement portion 63 is displaced forward (when the third pivot axis C3 is located below the first pivot axis C1, which will be described below). The two compression coil springs 60 with the biasing direction facing the forward/rearward direction are accommodated in the first internal space S1 of the support base main body portion 41 in a state being arranged in the widthwise direction. The two compression coil springs 60 are attached in a state being normally compressed to generate a biasing force even when the backrest 20 is in any one of the standing state P1 (see part (a) of FIG. 14) and the inclined state P2 (see part (b) of FIG. 14).

Figure 15:
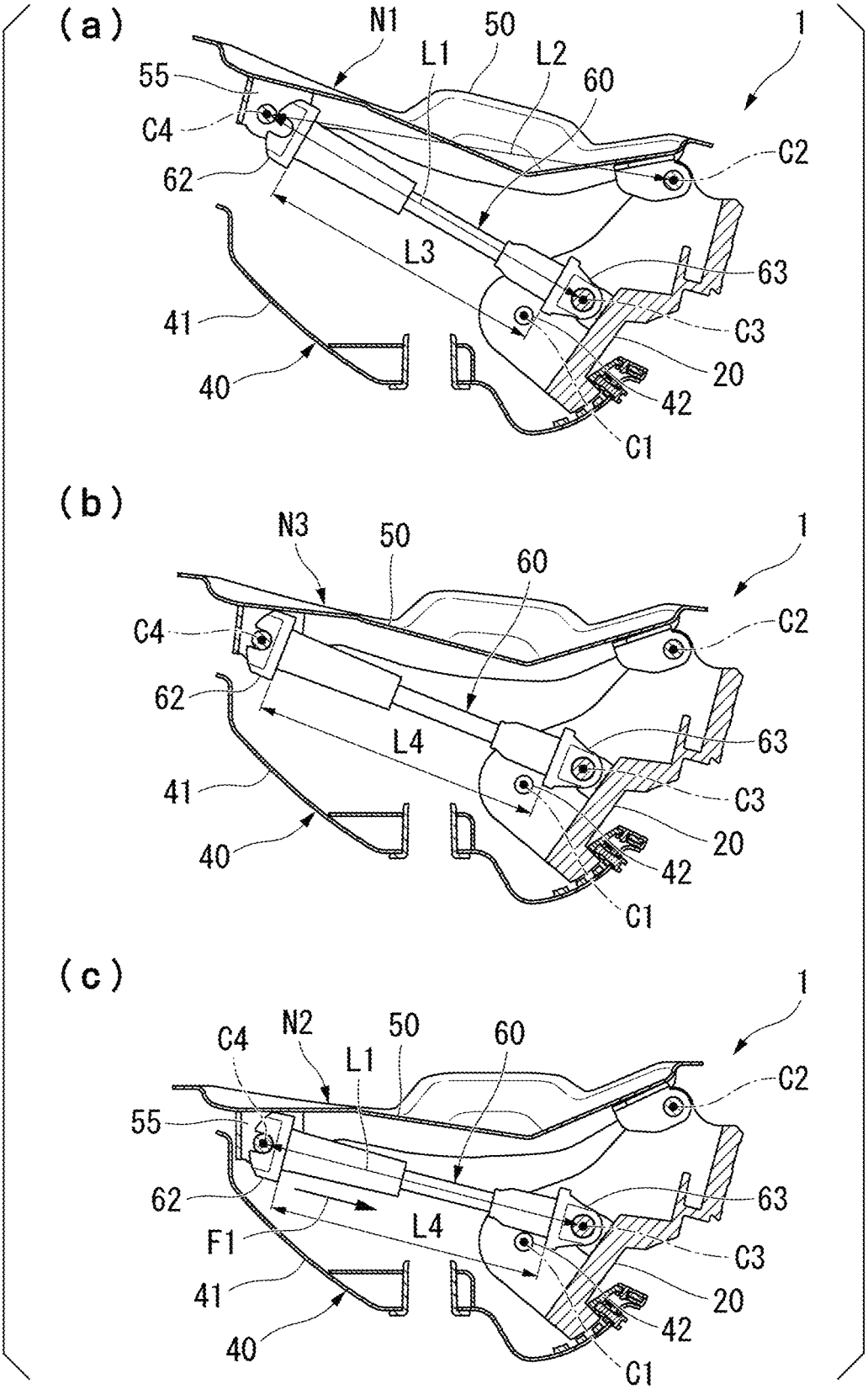
FIG. 15 are views showing assembly processes of the compression coil spring.

Further, specifically, the compression coil spring 60 is provided in a state in which the engaging protrusion 43 is located in the rear end portion of the slot 52 and a state in which it is compressed than a natural length (a length shown by reference sign L3 in part (a) of FIG. 15) between the front side spring receiving portion 55 and a rear side spring receiving portion 65 (a state compressed as shown by reference sign L4 in part (c) of FIG. 15).

The front side engagement portion 62 has an outer tube 62*b* extending on the side of the rear side engagement portion 63 in the axial direction of the compression coil spring 60 (a central axial direction of a coil). A spring shaft 64 is inserted through the compression coil spring 60. The spring shaft 64 has a front portion 64*a* slidably inserted through the outer tube 62*b* of the front side engagement portion 62, and a rear portion 64*b* is locked to a spring receiving part 64A fixed on the side of the rear side engagement portion 63. A rear end of the spring receiving part 64A has a flange portion 64*d* that supports the rear end portion of the compression coil spring 60 from behind. A circumferential surface of the spring shaft 64 on the side of the rear portion 64*b* includes a convex portion 64*c* protruding outward in the radial direction. The convex portion 64*c* abuts a front end 64*e* of the spring receiving part 64A from the front so as to restrict rearward movement of the spring shaft 64. The compression coil spring 60 has a front portion fitted onto the outer tube 62*b* of the front side engagement portion 62, and a rear portion fitted onto the spring receiving part 64A. As the compression coil spring 60 is compressed and stretched, the outer tube 62*b* of the front side engagement portion 62 and the spring receiving part 64A on the side of the rear side engagement portion 63 approach and are separated from each other to change a distance between them.

The front side engagement portion 62 abuts the front end of the compression coil spring 60 from the front. The front side engagement portion 62 is formed in a U shape that opens forward when seen in the widthwise direction. A concave portion 62*a* (first concave portion) recessed in a U shape is engaged with the front side spring reaction force receiving shaft 552 of the front side spring receiving portion 55 provided in the seat supporting member 50 while abutting it from behind. In this way, the compression coil spring 60 is engaged with the seat supporting member 50 in a state restricted the upward displacement by engaging the front side spring reaction force receiving shaft 552 with the inside of the concave portion 62*a* of the front side engagement portion 62. That is, the front side spring reaction force receiving shaft 552 receives a reaction force from the compression coil spring 60 regardless of whether the backrest 20 is in the standing state P1 or the inclined state P2. The front side spring receiving portion 55 is disposed behind an appropriate place in the range of the slot 52 in the forward/rearward direction.

Since the front side spring reaction force receiving shaft 552 is inserted into the concave portion 62*a* of the front side engagement portion 62, a surface of the concave portion 62*a* facing upward (a part of the front side engagement portion 62) abuts the front side spring reaction force receiving shaft 552 from below, and thus, upward displacement of the front side engagement portion 62 is restricted.

In addition, upward displacement of the front side engagement portion 62 may be restricted using a link bar or the like with one end connected to the front side engagement portion 62.

The rear side engagement portion 63 abuts the rear end of the compression coil spring 60 from behind. The rear side engagement portion 63 has a through-hole 63*a* (see FIG. 5) passing in the widthwise direction. A shaft portion 712 of a working shaft 71 of the adjustment portion 70, which will be described below, extending along the third pivot axis C3 in the widthwise direction is supported by the through-hole 63*a* in a state being inserted therethrough. The backrest 20 is rotatably engaged with the rear side engagement portion 63 of the compression coil spring 60 around the third pivot axis C3.

Further, the rear side engagement portion 63 may be configured such that a second concave portion that opens rearward is formed instead of the through-hole 63*a*. In this case, the second concave portion is engaged with the shaft portion 712 from the front while being capable of rotation relative to the shaft portion 712.

The rear side engagement portion 63 applies a spring force to the working shaft 71 from the front. That is, the working shaft 71 receives the reaction force (spring force) from the compression coil spring 60, regardless of whether the backrest 20 is in the standing state P1 or the inclined state P2.

Here, as shown in FIG. 5, FIG. 8 and FIG. 9, the rear side spring receiving portion 65 configured to rotatably support the rear side engagement portion 63 of the rear portion of the compression coil spring 60 around the third pivot axis C3 is provided on the pivoting member 38 of the backrest 20 via the shaft portion 712 of the working shaft 71. That is, the rear side engagement portion 63 and the rear side spring receiving portion 65 of the compression coil spring 60 use the shaft portion 712 as a common third pivot axis C3, and are provided to be rotatable around the third pivot axis C3.

The rear side spring receiving portion 65 is disposed while coming into surface-contact with a forward-facing inclined surface 38*c* (forward-facing surface) formed on the pivoting member 38 of the backrest 20 and facing forward and upward. The rear side spring receiving portion 65 is adjustable in position in the upward/downward direction with respect to the forward-facing inclined surface 38*c* by the adjustment portion 70, which will be described below, and has a receiving surface 65*a* that comes into surface-contact with the forward-facing inclined surface 38*c*.

Further, the forward-facing inclined surface 38*c* may have a concave groove formed therein extending in the upward/downward direction and engaging with the receiving surface 65*a*. Then, receiving surface 65*a* comes into surface-contact with a bottom surface of the concave groove. In this case, the rear side spring receiving portion 65 is movable in the upward/downward direction but the movement is restricted from moving in the widthwise direction. That is, by providing the concave groove, a position of the rear side spring receiving portion 65 in the widthwise direction is determined.

As shown in FIG. 8, the rear side spring receiving portion 65 includes a spring engaging portion 651 relatively movably engaged with the rear side engagement portion 63 of the compression coil spring 60 according to the displacement in the upward/downward direction, and a receiving part 652 disposed behind the spring engaging portion 651 and having the above-mentioned receiving surface 65*a*. Both side surfaces of the spring engaging portion 651 in the widthwise direction are spaced apart an interval in the widthwise direction from the support base main body portion 41 (support structure) or the sidewalls 382 of the pivoting member 38 of the backrest 20.

As shown in FIG. 9 and FIG. 10, the adjustment portion 70 has a function of adjusting a biasing force of the compression coil spring 60 and adjusting a returning force of the backrest 20 of the inclined state P2 (see part (b) of FIG. 14). The adjustment portion 70 is accommodated in the second internal space S2 between the sidewalls 382 of the pivoting member 38 of the backrest 20. The adjustment portion 70 adjusts the position of the rear side engagement portion 63 of the compression coil spring 60 in the upward/downward direction.

As shown in FIG. 9 to FIG. 13, the adjustment portion 70 includes the working shaft 71 operated by a biasing force of the compression coil spring 60, an adjusting shaft 72 configured to movably support the working shaft 71, and a support member 73 configured to rotatably support the adjusting shaft 72 relative to the operating part 80. The adjusting shaft 72 (a central portion, an intermediate piece) is located at a center of the second internal space S2 in the widthwise direction.

The adjusting shaft 72 has a second transmission gear 721 constituted by a bevel gear integrally attached to an upper end thereof. The second transmission gear 721 meshes with a first transmission gear 83 of the operating part 80, which will be described below, and a rotating force is transmitted from the first transmission gear 83 to the second transmission gear 721 by operating the operating part 80, causing the adjusting shaft 72 to rotate in both forward and reverse directions. The adjusting shaft 72 has a male thread formed thereon, onto which the working shaft 71 screws over the entire axial direction.

Figure 11:
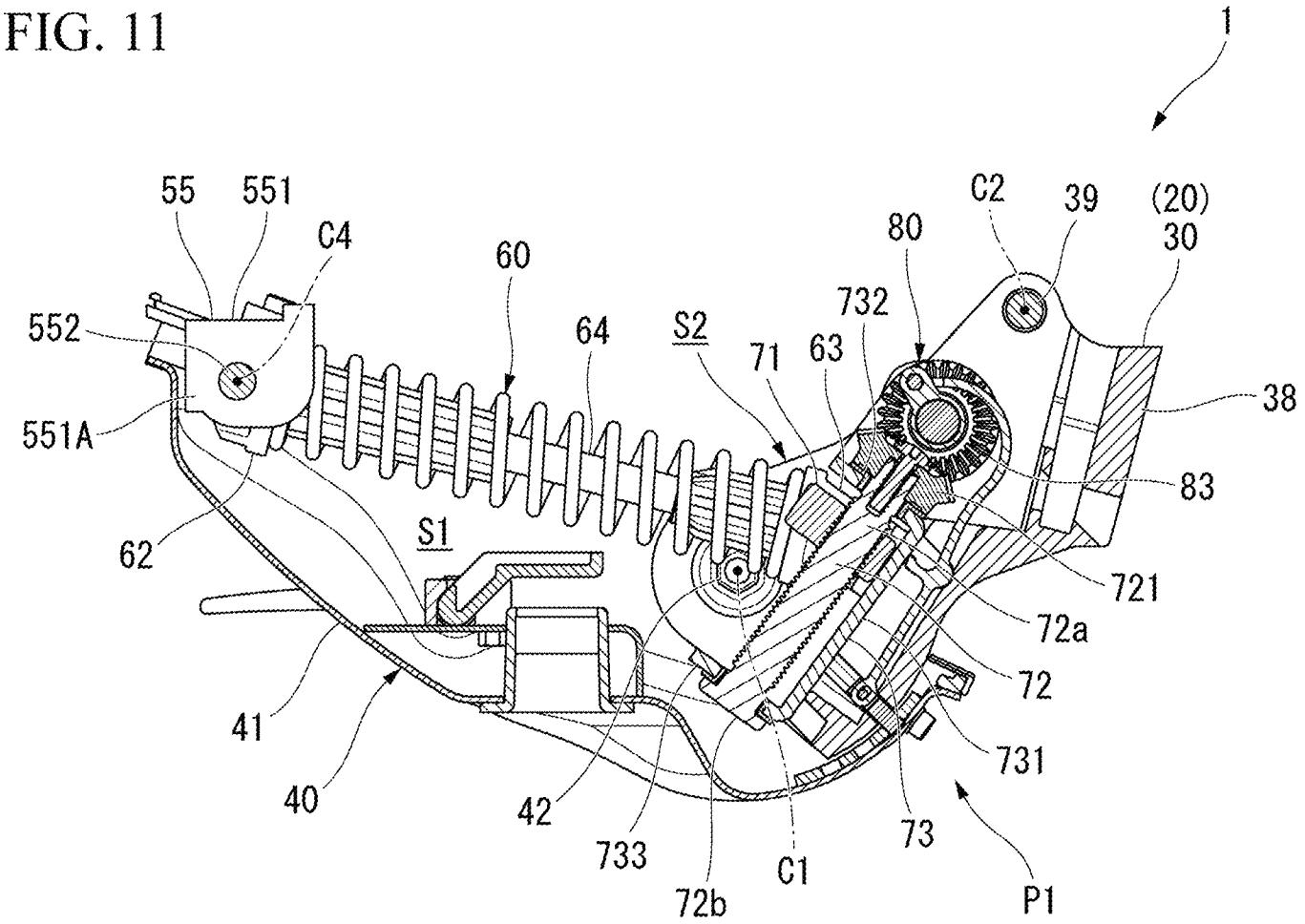
FIG. 11 is a cross-sectional view along line XI-XI shown in FIG. 10.
Figure 12:
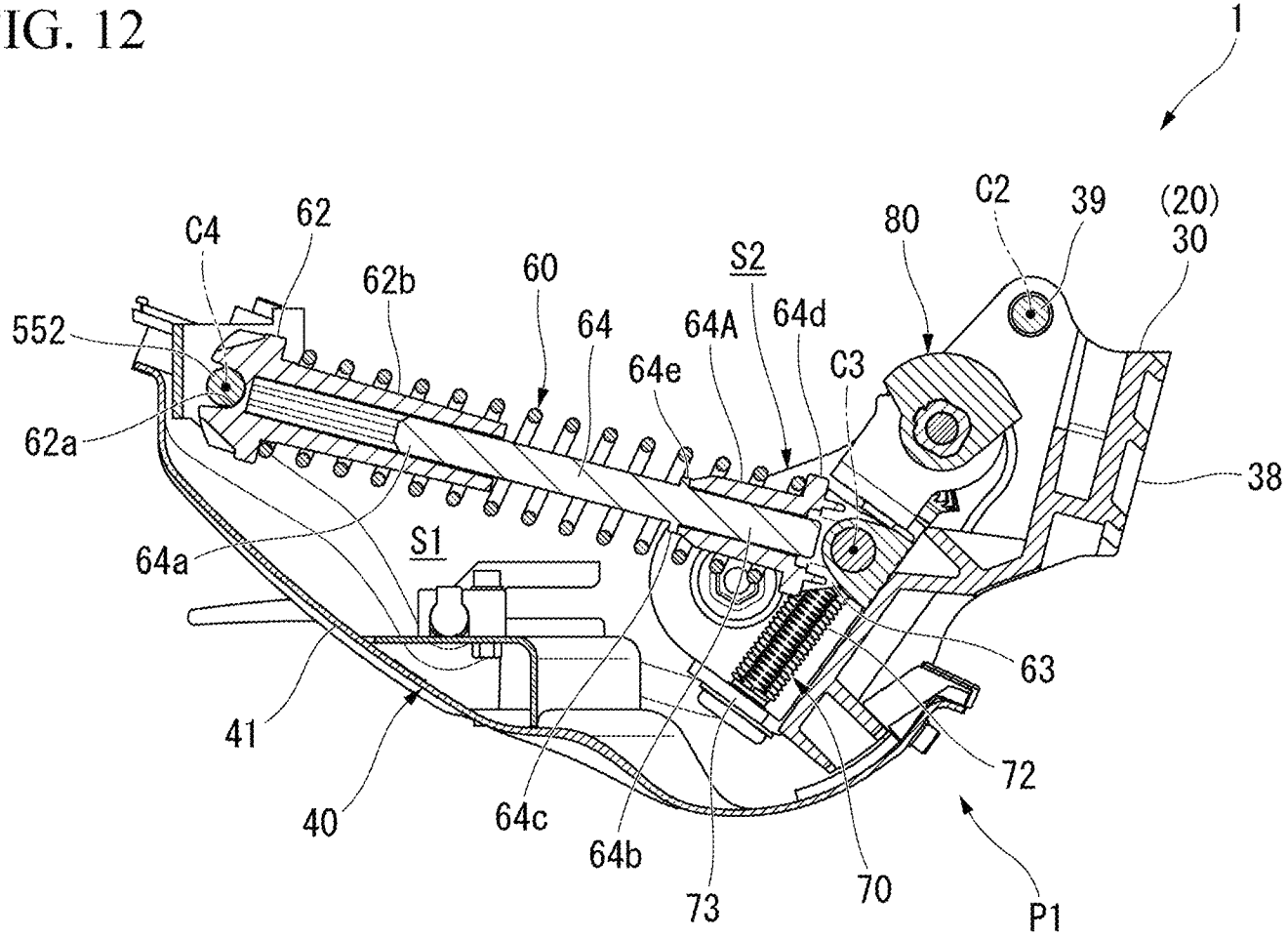
FIG. 12 is a cross-sectional view along line XII-XII shown in FIG. 10.

As shown in FIG. 11, in the standing state P1, the adjusting shaft 72 is disposed so that the axial direction is diagonally oriented from the front to the rear as it moves from a shaft lower end portion 72*b* to a shaft upper end portion 72*a* when seen from a side view. The shaft lower end portion 72*b* is located below the pivoting shaft 42 (the first pivot axis C1). The shaft upper end portion 72*a* is located above and behind the pivoting shaft 42. That is, the working shaft 71 moving along the adjusting shaft 72, i.e., the rear side engagement portion 63 provided on the rear end of the compression coil spring 60 connected to the working shaft 71 is configured to move between a position below the pivoting shaft 42 (a position shown by a two-dot chain line in part (a) of FIG. 14) and a position above and behind the pivoting shaft 42 (a position shown by a solid line in part (a) of FIG. 14).

In the adjustment portion 70, as the adjusting shaft 72 rotates, the working shaft 71 screwed onto the male thread is configured to move in the axial direction of the adjusting shaft 72 according to a rotation position of the adjusting shaft 72. That is, in the adjustment portion 70, the position of the working shaft 71 can be adjusted by moving the working shaft 71 along the adjusting shaft 72. When the working shaft 71 moves on the adjusting shaft 72, the compression coil spring 60 rotates around the front side engagement portion 62 (the fourth pivot axis C4), so only the angle seen in the widthwise direction changes.

Figure 13:
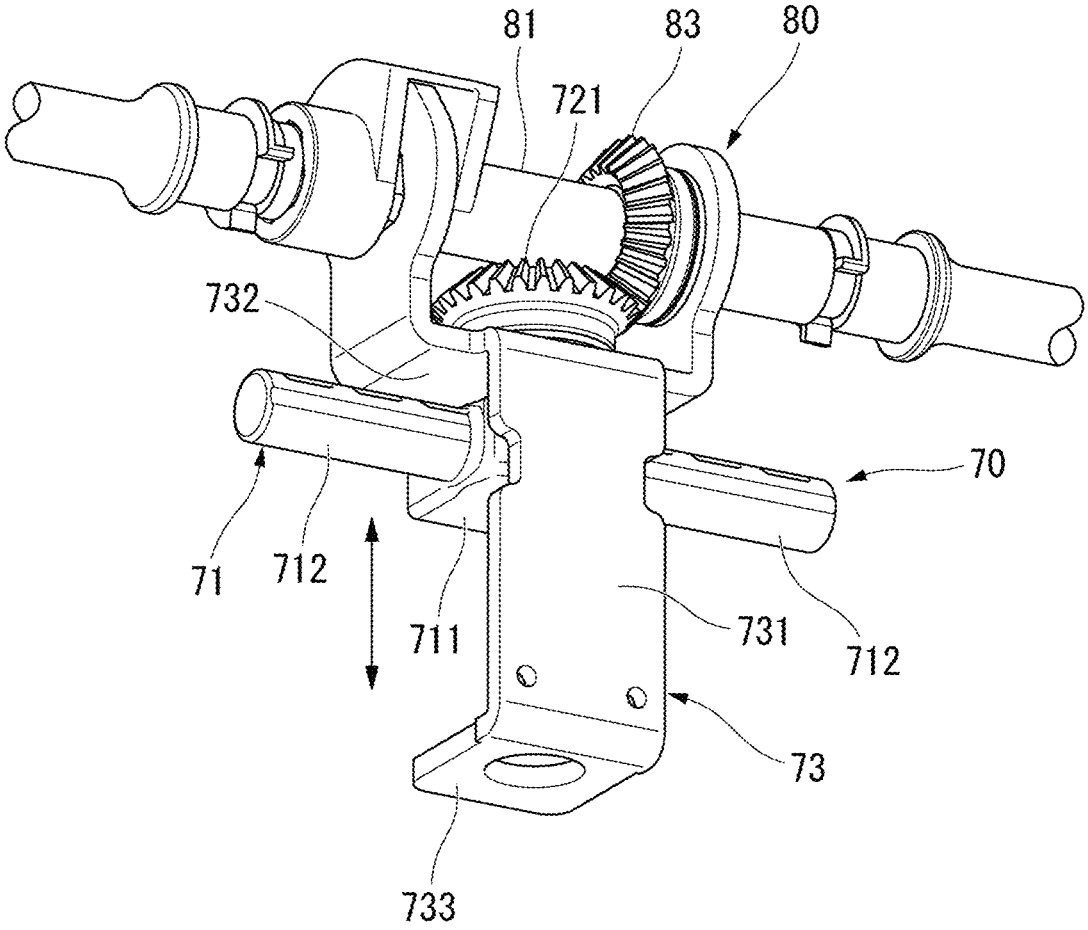
FIG. 13 is a perspective view showing an adjustment portion and an operating part from obliquely behind.

As shown in FIG. 8 and FIG. 13, the support member 73 has a fixing plate 731 extending in the upward/downward direction and fixed to the rear wall 381 of the pivoting member 38 by a screw (not shown), and an upper support plate 732 and a lower support plate 733 extending forward from upper and lower ends of the fixing plate 731. The adjusting shaft 72 is disposed between the upper support plate 732 and the lower support plate 733. As shown in FIG. 11, the adjusting shaft 72 has the shaft upper end portion 72*a* rotatably supported by the upper support plate 732, and the shaft lower end portion 72*b* rotatably supported by the lower support plate 733.

The working shaft 71 includes a nut portion 711 having a female thread screwed onto the adjusting shaft 72, and the shaft portion 712 extending on both left and right sides of the nut portion 711. The nut portion 711 moves along the adjusting shaft 72 as the adjusting shaft 72 rotates. As shown in FIG. 10, the rear side engagement portion 63 of the compression coil spring 60 is connected to the shaft portion 712.

As shown in FIG. 9, the operating part 80 is provided on the pivoting member 38. The operating part 80 has the operating shaft 81 extending in the leftward/rightward direction, an operating lever 82 provided on a protruded tip (one end) of the operating shaft 81 protruding outward from the sidewalls 382, and the first transmission gear 83 provided on an intermediate portion of the operating shaft 81 and constituted by a bevel gear located in the second internal space S2.

That is, in the operating part 80, an outer end portion of the operating shaft 81 in the widthwise direction protrudes from the sidewalls 382 in the widthwise direction, and an inner portion in the widthwise direction is disposed in the second internal space S2 and connected to the adjustment portion 70.

The operating shaft 81 is disposed in a state in which upper portions of the sidewalls 382 of the pivoting member 38 protrude outward. The operating shaft 81 is disposed above the adjusting shaft 72, and disposed such that the pivot axis of the operating shaft 81 and the pivot axis of the adjusting shaft 72 are located in the same plane.

The first transmission gear 83 provided on the intermediate portion of the operating shaft 81 in the axial direction is meshed with the second transmission gear 721 provided on the adjusting shaft 72. That is, the rotation of the operating shaft 81, i.e., the rotation around the pivot axis extending in the leftward/rightward direction of the first transmission gear 83, has its rotation direction converted to rotation around the pivot axis of the adjusting shaft 72 of the second transmission gear 721.

The operating lever 82 is located at a position in front of the sidewalls 382 of the pivoting member 38 in the widthwise direction and behind the seat supporting member 50. That is, the position of the operating lever 82 is a position below and behind the seat supporting member 50, and a position that is easily accessible to the hands of the seated person sitting on the seat main body 51 on the seat supporting member 50.

In the chair 1 configured in this way, when the reaction force (returning force) of the backrest 20 is adjusted, if the operating lever 82 of the operating part 80 rotates first, the working shaft 71 located at the position of the rear side engagement portion 63 of the compression coil spring 60 vertically moves along the adjusting shaft 72. For example, by rotating the operating lever 82 in one direction, the adjusting shaft 72 rotates in one direction via the first transmission gear 83 and the second transmission gear 721, and the nut portion 711 screwed onto the adjusting shaft 72, i.e., the working shaft 71 moves upward along the adjusting shaft 72.

As the working shaft 71 moves on the adjusting shaft 72, as shown in parts (a) and (b) of FIG. 14, a compression amount of the compression coil spring 60, i.e., a biasing force (reaction force) of the compression coil spring 60 can be adjusted by changing the distance between the front side engagement portion 62 and the rear side engagement portion 63 of the compression coil spring 60. That is, the returning force when the backrest 20 returns to the standing state P1 from the inclined state P2 can be adjusted.

Here, part (a) of FIG. 14 is a view in which the backrest 20 is in the standing state P1, and part (b) of FIG. 14 is a view in which the backrest 20 is in the inclined state P2. Then, the compression coil spring 60 shown by a solid line of parts (a) and (b) of FIG. 14 indicate an upper limit position T1 when the adjustment portion 70 is used, and the compression coil spring 60 shown by a two-dot chain line indicates a lower limit position T2 when the adjustment portion 70 is used.

Further, in the embodiment, as shown in parts (a) and (b) of FIG. 14, when the rear side engagement portion 63 is located at the upper limit position T1, a distance between the front side engagement portion 62 (the fourth pivot axis C4) and the rear side engagement portion 63 (the third pivot axis C3) when the backrest 20 is in the inclined state P2 is smaller than a distance between the front side engagement portion 62 (the fourth pivot axis C4) and the rear side engagement portion 63 (the third pivot axis C3) when the backrest 20 is in the standing state P1. Even when the rear side engagement portion 63 is located at the lower limit position T2, a distance between the front side engagement portion 62 (the fourth pivot axis C4) and the rear side engagement portion 63 (the third pivot axis C3) when the backrest 20 is in the inclined state P2 is smaller than a distance between the front side engagement portion 62 (the fourth pivot axis C4) and the rear side engagement portion 63 (the third pivot axis C3) when the backrest 20 is in the standing state P1. That is, even when the rear side engagement portion 63 is located at any one position between the upper limit position T1 and the lower limit position T2, the compression coil spring 60 can generate a returning force that returns the backrest 20 from the inclined state P2 to the standing state P1 and returns the seat 5 from the rear to the front.

The upper limit position T1 of the rear side engagement portion 63 (the third pivot axis C3) of the compression coil spring 60 adjusted by the adjustment portion 70 is set to a position above the first pivot axis C1. In addition, as shown in FIG. 5, the upper limit position T1 of the rear side engagement portion 63 (the third pivot axis C3) is set to a front lower side of the rear attachment portion 53 (the second pivot axis C2). Further, a distance L5 between the first pivot axis C1 and the rear side engagement portion 63 (the third pivot axis C3) located at the upper limit position T1 is set to be smaller than a distance between the first pivot axis C1 and the rear attachment portion 53 (the second pivot axis C2).

In this way, in the adjustment portion 70 of the embodiment, by moving the working shaft 71 on the adjusting shaft 72, the position of the working shaft 71, i.e., the position of the rear side engagement portion 63 of the compression coil spring 60 can be changed to adjust the biasing force of the compression coil spring 60 (the returning force of the backrest 20). Then, in the embodiment, in terms of the mechanism, the working shaft 71 that moves the adjusting shaft 72 can be adjusted up to a position above the pivoting shaft 42 in the upward/downward direction.

Next, positional relations between the above-mentioned pivot axiss C1, C2, C3 and C4 will be further described in detail.

As shown in parts (a) and (b) of FIG. 14, in the chair 1 of the embodiment, a first distance L1 between the third pivot axis C3 and the fourth pivot axis C4 is set to be smaller than a second distance L2 between the second pivot axis C2 and the fourth pivot axis C4.

In addition, as shown in part (a) of FIG. 15, in the chair 1, in a state before assembly in which the slot 52 of the seat 5 is moved upward from the front portion (the engaging protrusion 43) of the support base main body portion 41 of the support base 40 and the seat supporting member 50 is opened upward, the seat supporting member 50 is configured to open to a first position N1 where the first distance L1 gets greater than a natural length L3 of the compression coil spring 60. That is, in a state in which the seat supporting member 50 is located at the first position N1, the front side engagement portion 62 of the compression coil spring 60 having the natural length L3 and engaging the rear side engagement portion 63 with the backrest 20 can be engaged with the front side spring receiving portion 55 of the seat supporting member 50.

In addition, as shown in part (c) of FIG. 15, in the state after assembly in which the slot 52 of the seat 5 is engaged with the front portion (the engaging protrusion 43) of the support base main body portion 41 of the support base 40 to close the seat supporting member 50, it is set to a second position N2 where the first distance L1 is smaller than the natural length L3 of the compression coil spring 60. That is, in the state after assembly, the compression coil spring 60 is attached with an initial reaction force to which a compression force (an arrow F1 shown in part (c) of FIG. 15) is applied from the front side engagement portion 62.

Further, part (b) of FIG. 15 shows a third position N3 from the first position N1 until the second position N2 in a state before assembly of the compression coil spring 60, and the first distance L1 is smaller than the natural length L3 of the compression coil spring 60. A compression force (the arrow F1 shown in part (c) of FIG. 15) from the front side engagement portion 62 is applied to the compression coil spring 60 even at the third position N3.

Here, a reaction force of the compression coil spring 60 changed depending on a tilt angle (reclining angle) of the backrest will be described with reference to FIG. 16 and FIG. 17.

Figure 16:
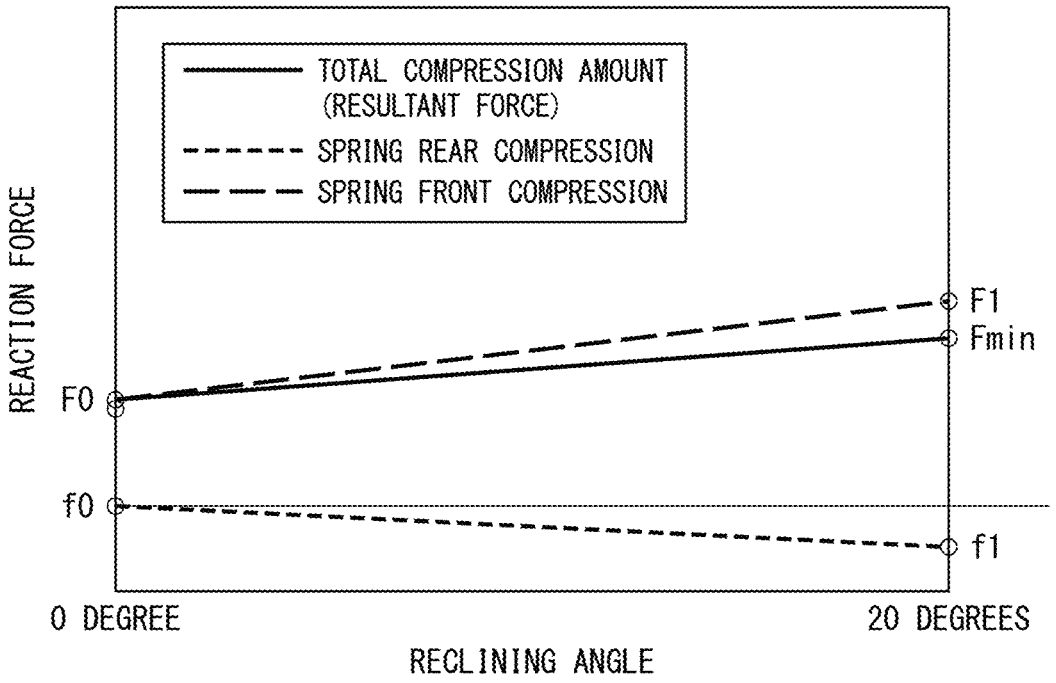
FIG. 16 is a view showing a relation between a tilt angle of the backrest and a reaction force of the compression coil spring and a view when a position of the rear side engagement portion of the compression coil spring is set to an upper limit position.

FIG. 16 shows an example of a case in which a position of the rear side engagement portion 63 of the compression coil spring 60 (a position of the third pivot axis C3) is set as the upper limit position T1 by the adjustment portion 70. FIG. 17 shows an example of a case in which a position of the rear side engagement portion 63 of the compression coil spring 60 (a position of the third pivot axis C3) is set as the lower limit position T2 by the adjustment portion 70. In FIG. 16 and FIG. 17, "spring front compression" indicates an amount (reaction force) of rearward compression at the front side engagement portion 62 of the compression coil spring 60, "spring rear compression" indicates an amount (reaction force) of forward compression at the rear side engagement portion 63 of the compression coil spring 60, and "total compression amount (resultant force)" indicates a resultant force of the compression amounts of "the spring front compression" and "the spring rear compression." As a result, in both the upper limit position T1 and the lower limit position T2, the total compression amount (resultant force) increases as the reclining angle increases. In the case of the upper limit position T1, since the third pivot axis C3 is located above the first pivot axis C1, as the reclining angle increases, the amount of compression pushing forward by the rear side engagement portion 63 is negative, i.e., a tensile force is acting, but since the amount of compression pushing backward by the front side engagement portion 62 is greater, the resultant force increases as the reclining angle increases.

Figure 17:
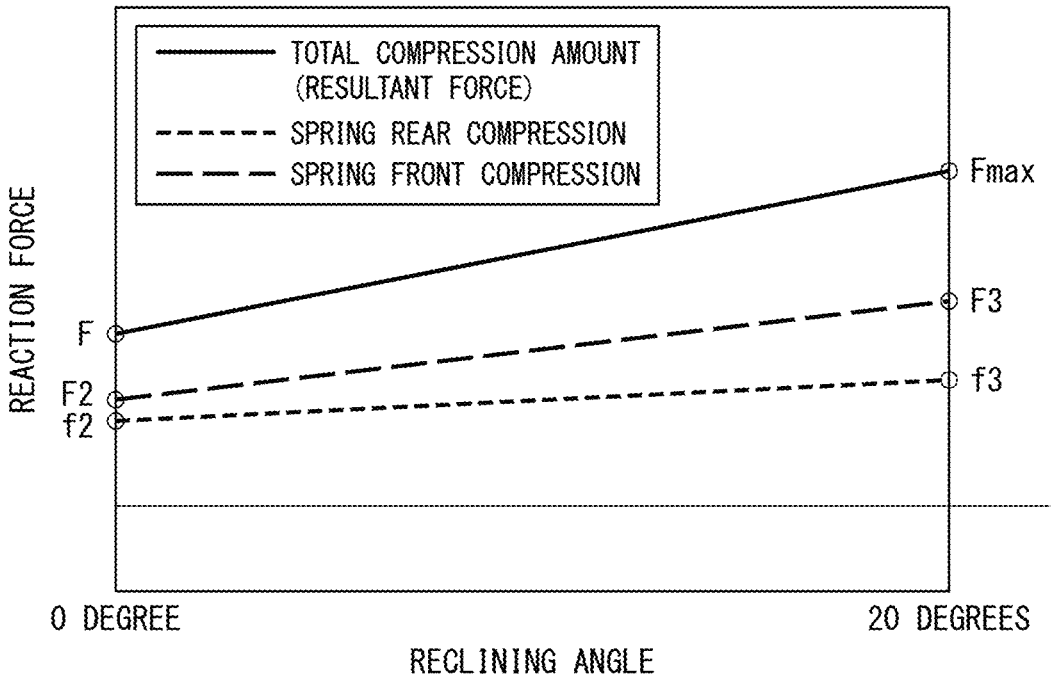
FIG. 17 is a view showing a relation between a tilt angle of the backrest and a reaction force of the compression coil spring and a view when a position of the rear side engagement portion of the compression coil spring is set to a lower limit position.

In addition, in the case of the lower limit position T2 shown in FIG. 17, the total compression amount (resultant force) is greater than that in the case of the upper limit position T1. The reason for this is that in the case of the lower limit position T2, the third pivot axis C3 is located below the first pivot axis C1, when the reclining angle increases, the amount of compression pressing forward by the rear side engagement portion 63 increases significantly.

In this way, even when the third pivot axis C3 is located above the first pivot axis C1, the resultant force can be increased as the reclining angle increases.

In the chair 1 configured in this way, since the position of the rear side engagement portion 63 of the compression coil spring 60 is set above the first pivot axis C1, the rear side engagement portion 63 of the compression coil spring 60 is displaced rearward without being displaced forward by tilting the backrest 20 from the standing state P1 (see part (a) of FIG. 14) to the inclined state (see part (b) of FIG. 14). That is, when the backrest 20 is tilted, the compression coil spring 60 is not compressed by the rear side engagement portion 63, and only compression is applied by the front side engagement portion 62 of the compression coil spring 60 joined to the seat supporting member 50, which is displaced rearward as the backrest 20 tilts. Then, in this case, the biasing force is smaller than when compression is exerted by both the backrest 20 and the seat supporting member 50.

Accordingly, in the embodiment, it is possible to ensure a large adjustment region in the upward/downward direction of the rear side engagement portion 63 (the rear side spring receiving portion 65) of the compression coil spring 60 by using the adjustment portion 70 in the region above the first pivot axis C1. That is, the adjustment portion allows the adjustment width of the spring reaction force to be increased without providing a large adjustment region below the first pivot axis C1 in the backrest 20.

In addition, in the embodiment, as shown in FIG. 5 and parts (a) and (b) of FIG. 14, the upper limit position T1 of the rear side engagement portion 63 is set in front of and below the rear attachment portion 53 (the second pivot axis C2). The distance L5 between the first pivot axis C1 and the rear side engagement portion 63 at the upper limit position T1 is smaller than a distance L6 between the first pivot axis C1 and the rear attachment portion 53 (the second pivot axis C2).

With this configuration, the rear side engagement portion 63 of the compression coil spring 60, which is located above the first pivot axis C1, does not move forward and compress the compression coil spring 60 due to the tilting of the backrest 20.

Specifically, while the compression coil spring 60 moves rearward to expand, since the biasing force from the compression coil spring 60 attempting to return to the natural length state is applied to the rear attachment portion 53 located on the rear portion of the seat supporting member 50 and the distance L5 between the first pivot axis C1 and the upper limit position T1 of the rear side engagement portion 63 of the compression coil spring 60 is smaller than the distance L6 between the first pivot axis C1 and the rear attachment portion 53 (the second pivot axis C2), a pressing force is constantly applied from above to the rear side engagement portion 63 of the compression coil spring 60 via the backrest 20. This pressing force resists the rearward movement of the rear side engagement portion 63 due to the biasing force of the compression coil spring 60, preventing the compression coil spring 60 from expanding and biasing the backrest 20 in a rearward pivoting direction so as to cause the rear side engagement portion 63 to move rearward.

In addition, in the embodiment, the front side engagement portion 62 engages with the seat supporting member 50 in a state in which upward displacement is restricted, and the compression coil spring 60 does not extend upward. For this reason, the rearward displacement of the seat supporting member 50 can be reliably converted into a force of pressing the front side engagement portion 62 of the compression coil spring 60 from the front to the rear.

In addition, in the embodiment, since the slot 52 (i.e., the front portion of the seat supporting member 50) moves rearward and downward when the backrest 20 is displaced from the standing state P1 to the inclined state P2 and the compression coil spring 60 does not expand upward in a process in which the seat supporting member 50 is displaced, rearward displacement of the seat supporting member 50 can be reliably converted into a force of pressing the front side engagement portion 62 of the compression coil spring 60 from the front to the rear.

Further, the technical scope of the present invention is not limited to the embodiment, and various modifications may be made without departing from the scope of the present invention.

For this reason, in the above-mentioned embodiment, the compression coil spring 60 is provided while being compressed between the seat 5 and the backrest 20, the front side engagement portion 62 of the compression coil spring 60 is engaged with the seat 5, and the rear side engagement portion 63 of the compression coil spring 60 is engaged with the backrest 20. However, the compression coil spring 60 may be provided while being compressed between the seat 5 and the support base main body portion 41, the front side engagement portion 62 may be engaged with the seat 5, and the rear side engagement portion 63 may be engaged with the support base main body portion 41 (support structure). Since the seat 5 is connected to the pivoting member 38 of the backrest 20 via the rear attachment portion 53, by biasing the seat 5, behind which the compression coil spring 60 is located, toward the front, the backrest 20 in the inclined state P2 can be biased toward the standing state P1. In addition, the front side engagement portion 62 of the compression coil spring 60 is engaged with the front side spring receiving portion 55 formed on the lower surface of the seat supporting member 50, i.e., directly engaged with the seat 5, but may also be engaged with a member that is pushed to be displaced rearward by the seat 5 when the seat 5 is displaced in the direction of an arrow E4.

In addition, it is also possible to provide a configuration in which the compression coil spring 60 is provided while being compressed between the support base main body portion 41 and the backrest 20, the front side engagement portion 62 is engaged with the support base main body portion 41, and the rear side engagement portion 63 is engaged with the backrest 20. Even in this configuration, the compression coil spring 60 can bias the backrest 20 in the inclined state P2 toward the standing state P1. In addition, since the seat 5 is connected to the pivoting member 38 of the backrest 20 via the rear attachment portion 53, the seat 5 located at the rear can be biased forward according to movement of the backrest 20 in the inclined state P2 to the standing state P1.

In addition, although the compression coil spring 60 is used as the spring member in the embodiment, it is not limited to this and other spring members such as a torsion coil spring or the like can also be used. In addition, the spring is not limited to a compression spring, and a tensile spring such as a tensile coil spring or the like may also be used.

In addition, while the concave portion 62*a* (first concave portion) is formed in the front side engagement portion 62 of the compression coil spring 60 and the front side spring receiving portion 55 has the front side spring reaction force receiving shaft 552 coaxial with the fourth pivot axis C4 engaged with the concave portion 62*a* in the embodiment, a first concave portion may be provided in the front side spring receiving portion 55 and the front side engagement portion 62 may have a shaft member inserted into the first concave portion. In this case, since the upper portion of the shaft member of the front side engagement portion 62 abuts a surface of the first concave portion directed downward from below, the front side engagement portion 62 of the compression coil spring 60 can be restricted from moving upward.

In addition, while the pivoting member 38 of the backrest 20 includes the two sidewalls 382 separated in the widthwise direction and the adjustment portion 70 is disposed in the space (the second internal space S2) between the sidewalls 382 in the embodiment, the two sidewalls 382 of the pivoting member 38 may not be provided.

In addition, while the second internal space S2 is a part of the first internal space S1 in the embodiment, there is no limitation thereto and the first internal space S1 and the second internal space S2 may be separated without overlapping.

Further, in addition, specific configurations or dispositions of the compression coil spring 60, the adjustment portion 70, and the operating part 80 may be modified as appropriate. For example, while the two compression coil springs 60 are employed as the spring members in the embodiment, another biasing member may be employed.

In addition, within the scope of the present invention, components in the embodiments may be replaced with well-known components as appropriate, and the above-mentioned variants may be combined as appropriate.

The chair 1 includes the support base main body portion 41 (support structure), the backrest 20 that is rotatably supported by the support base main body portion 41 around the first pivot axis C1 (pivot axis) in the chair widthwise direction and that is displaceable in the forward/rearward direction between the standing state P1 and the inclined state P2, the seat 5 that has the slot 52 (front side supported part) movably supported in the forward/rearward direction relative to the front portion of the support base main body portion 41 and the rear attachment portion 53 (rear side supported part) supported at the position above the first pivot axis C1, and that is displaceable in the forward/rearward direction depending on displacement of the backrest 20 with respect to the support base main body portion 41, and the compression coil spring 60 (spring member) that is provided in a state compressed between the seat 5 and the backrest 20 or between the seat 5 and the support base main body portion 41 and that is configured to bias the backrest 20 in a direction of returning to the standing state P1, the compression coil spring 60 is disposed so that the biasing direction is in the forward/rearward direction, and includes the front side engagement portion 62 disposed on a front portion of the spring and the rear side engagement portion 63 disposed on a rear portion of the spring, the seat 5 includes the front side spring receiving portion 55 engaged with the front side engagement portion 62, the backrest 20 or the support base main body portion 41 includes the rear side spring receiving portion 65 configured to engage with the rear side engagement portion 63 and the adjustment portion 70 configured to adjust a position of the rear side engagement portion 63 in the upward/downward direction together with the rear side spring receiving portion 65, and the upper limit position T1 of the rear side engagement portion 63 of the compression coil spring 60 adjusted by the adjustment portion 70 is located above the first pivot axis C1.

A variant of the chair 1 includes the support base main body portion 41, the backrest 20 that is rotatably supported by the support base main body portion 41 around the first pivot axis C1 in the chair widthwise direction and that is displaceable in the forward/rearward direction between the standing state P1 and the inclined state P2, the seat 5 that has the slot 52 movably supported in the forward/rearward direction relative to the front portion of the support base main body portion 41 and the rear attachment portion 53 supported at a position above the first pivot axis C1, and that is displaceable in the forward/rearward direction depending on displacement of the backrest 20 with respect to the support base main body portion 41, and the compression coil spring 60 that is provided in a state compressed between the support base main body portion 41 and the backrest 20 and that is configured to bias the backrest 20 in a direction of returning to the standing state P1, the compression coil spring 60 is disposed so that the biasing direction is in the forward/rearward direction, and includes the front side engagement portion 62 disposed on a front portion of the spring and the rear side engagement portion 63 disposed on a rear portion of the spring, the support base main body portion 41 includes a front side spring receiving portion configured to engage with the front side engagement portion 62, the backrest 20 includes a rear side spring receiving portion configured to engage with the rear side engagement portion 63 and the adjustment portion 70 configured to adjust a position of the rear side engagement portion 63 in the upward/downward direction together with the rear side spring receiving portion, and the upper limit position T1 of the rear side engagement portion 63 of the compression coil spring 60 adjusted by the adjustment portion 70 is located above the first pivot axis C1.

In the chair 1, the upper limit position T1 of the rear side engagement portion 63 is disposed in front of and below the rear attachment portion 53, and a distance between the first pivot axis C1 and the rear side engagement portion 63 at the upper limit position T1 is smaller than a distance between the first pivot axis C1 and the rear attachment portion 53.

In the chair 1, the front side engagement portion 62 is engaged with the seat 5 in a state in which upward displacement is restricted.

In the chair 1, the slot 52 moves rearward and downward when the backrest 20 is displaced from the standing state P1 to the inclined state P2.

In the chair 1, the slot 52 extends rearward and downward.

In the chair 1, the lower limit position T2 of the rear side engagement portion 63 of the compression coil spring 60 adjusted by the adjustment portion 70 is located below the first pivot axis C1.

In the chair 1, the rear attachment portion 53 of the seat 5 is rotatably connected to the backrest 20.

REFERENCE SIGNS LIST

1 Chair
5 Seat
20 Backrest
20A Backrest structure
30 Backrest support member
38 Pivoting member
39 Shaft member
40 Support base
41 Support base main body portion (support structure)
42 Pivoting shaft
50 Seat supporting member
51 Seat main body
52 Slot (front side supported part)
53 Rear attachment portion (rear side supported part)
55 Front side spring receiving portion
60 Compression coil spring (spring member)
62 Front side engagement portion
63 Rear side engagement portion
65 Rear side spring receiving portion
70 Adjustment portion
71 Working shaft
72 Adjusting shaft
80 Operating part
411*a* Lower shielding surface
552 Front side spring reaction force receiving shaft
C1 First pivot axis (pivot axis)
C2 Second pivot axis
C3 Third pivot axis
C4 Fourth pivot axis

The invention claimed is:

1. A chair comprising:

a support structure;

a backrest that is rotatably supported by the support structure around a pivot axis in a chair widthwise direction and that is displaceable in a forward/rearward direction between a standing state and an inclined state;

a seat that has a front side supported part movably supported in the forward/rearward direction relative to a front portion of the support structure and a rear side supported part supported at a position above the pivot axis, and that is displaceable in the forward/rearward direction depending on displacement of the backrest with respect to the support structure; and a compression coil spring member that is provided in a state compressed between the seat and the backrest or between the seat and the support structure and that is configured to bias the backrest in a direction of returning to the standing state, wherein the compression coil spring member is disposed so that a biasing direction is in the forward/rearward direction, and includes a front side engagement portion disposed on a front portion of the spring and a rear side engagement portion disposed on a rear portion of the spring, the seat includes a front side spring receiving portion engaged with the front side engagement portion, the backrest or the support structure includes a rear side spring receiving portion configured to engage with the rear side engagement portion and an adjustment portion configured to adjust a position of the rear side engagement portion in an upward/downward direction together with the rear side spring receiving portion, an upper limit position of the rear side engagement portion of the compression coil spring member adjusted by the adjustment portion is located above the pivot axis, a front part of the compression coil spring member is constantly applying a spring reaction force with respect to the front side spring receiving portion, and when the backrest displaces to the inclined state, the front side spring receiving portion displaces rearward against the spring reaction force and presses the front side engagement portion rearward.

2. The chair according to claim 1, wherein the upper limit position of the rear side engagement portion is disposed in front of and below the rear side supported part, and a distance between the pivot axis and the rear side engagement portion at the upper limit position is smaller than a distance between the pivot axis and the rear side supported part.

3. The chair according to claim 1, wherein the front side engagement portion is engaged with the seat in a state in which upward displacement is restricted.

4. The chair according to claim 1, wherein the front side supported part moves rearward and downward when the backrest is displaced from the standing state to the inclined state.

5. The chair according to claim 4, wherein the front side supported part extends rearward and downward.

6. The chair according to claim 1, wherein a lower limit position of the rear side engagement portion of the compression coil spring member adjusted by the adjustment portion is located below the pivot axis.

7. The chair according to claim 1, wherein the rear side supported part of the seat is rotatably connected to the backrest.

8. A chair comprising:

a support structure;

a backrest that is rotatably supported by the support structure around a pivot axis in a chair widthwise direction and that is displaceable in a forward/rearward direction between a standing state and an inclined state;

a seat that has a front side supported part movably supported in the forward/rearward direction relative to a front portion of the support structure and a rear side supported part supported at a position above the pivot axis, and that is displaceable in the forward/rearward direction depending on displacement of the backrest with respect to the support structure; and a spring member that is provided in a state compressed between the support structure and the backrest and that is configured to bias the backrest in a direction of returning to the standing state, wherein the spring member is disposed so that a biasing direction is in the forward/rearward direction, and includes a front side engagement portion disposed on a front portion of the spring and a rear side engagement portion disposed on a rear portion of the spring, the support structure includes a front side spring receiving portion configured to engage with the front side engagement portion, the backrest includes a rear side spring receiving portion configured to engage with the rear side engagement portion and an adjustment portion configured to adjust a position of the rear side engagement portion in the upward/downward direction together with the rear side spring receiving portion, and an upper limit position of the rear side engagement portion of the spring member adjusted by the adjustment portion is located above the pivot axis.

9. The chair according to claim 2, wherein the upper limit position of the rear side engagement portion is disposed in front of and below the rear side supported part, and a distance between the pivot axis and the rear side engagement portion at the upper limit position is smaller than a distance between the pivot axis and the rear side supported part.

10. The chair according to claim 2, wherein the front side engagement portion is engaged with the seat in a state in which upward displacement is restricted.

11. The chair according to claim 2, wherein the front side supported part moves rearward and downward when the backrest is displaced from the standing state to the inclined state.

12. The chair according to claim 11, wherein the front side supported part extends rearward and downward.

13. The chair according to claim 2, wherein a lower limit position of the rear side engagement portion of the spring member adjusted by the adjustment portion is located below the pivot axis.

14. The chair according to claim 2, wherein the rear side supported part of the seat is rotatably connected to the backrest.

* * * * *